United States Patent [19]

Hasenbalg

[11] 4,074,359

[45] Feb. 14, 1978

[54] VECTOR GENERATOR

[75] Inventor: Ralph D. Hasenbalg, Canoga Park, Calif.

[73] Assignee: Vector General, Inc., Woodland Hills, Calif.

[21] Appl. No.: 728,544

[22] Filed: Oct. 1, 1976

[51] Int. Cl.[2] ..... G06G 7/22; G06G 7/26; H01J 29/70

[52] U.S. Cl. ..... 364/521; 315/364; 340/324 A; 364/855

[58] Field of Search ..... 235/198, 151, 197, 186, 235/189; 340/324 A, 324 AD; 315/364, 367, 379, 387, 395

[56] References Cited

U.S. PATENT DOCUMENTS

| | | | |
|---|---|---|---|
| 3,482,086 | 12/1969 | Caswell | 235/186 |
| 3,638,214 | 1/1972 | Scott et al. | 235/198 X |
| 3,772,563 | 11/1973 | Hasenbalg | 235/198 X |
| 3,842,310 | 10/1974 | Harf | 315/387 X |
| 3,869,085 | 3/1975 | Green | 235/198 |

*Primary Examiner*—Joseph F. Ruggiero
*Attorney, Agent, or Firm*—Robert Louis Finkel

[57] ABSTRACT

A high speed vector generating electrical system is provided which provides the deflection voltages required to draw a vector line from one point to another on the screen of a cathode-ray tube. The system is particularly useful for drawing images in any desired pattern on the screen of the cathode-ray tube, whereby the images are composed of a multitude of vector lines. The system of the invention is simplified as compared with the prior art systems of the same general type, and it requires less adjustments and exhibits greater stability. The system also has a readily programmable drawing rate, and it requires shorter drawing time for short vectors.

10 Claims, 12 Drawing Figures

PRIOR ART

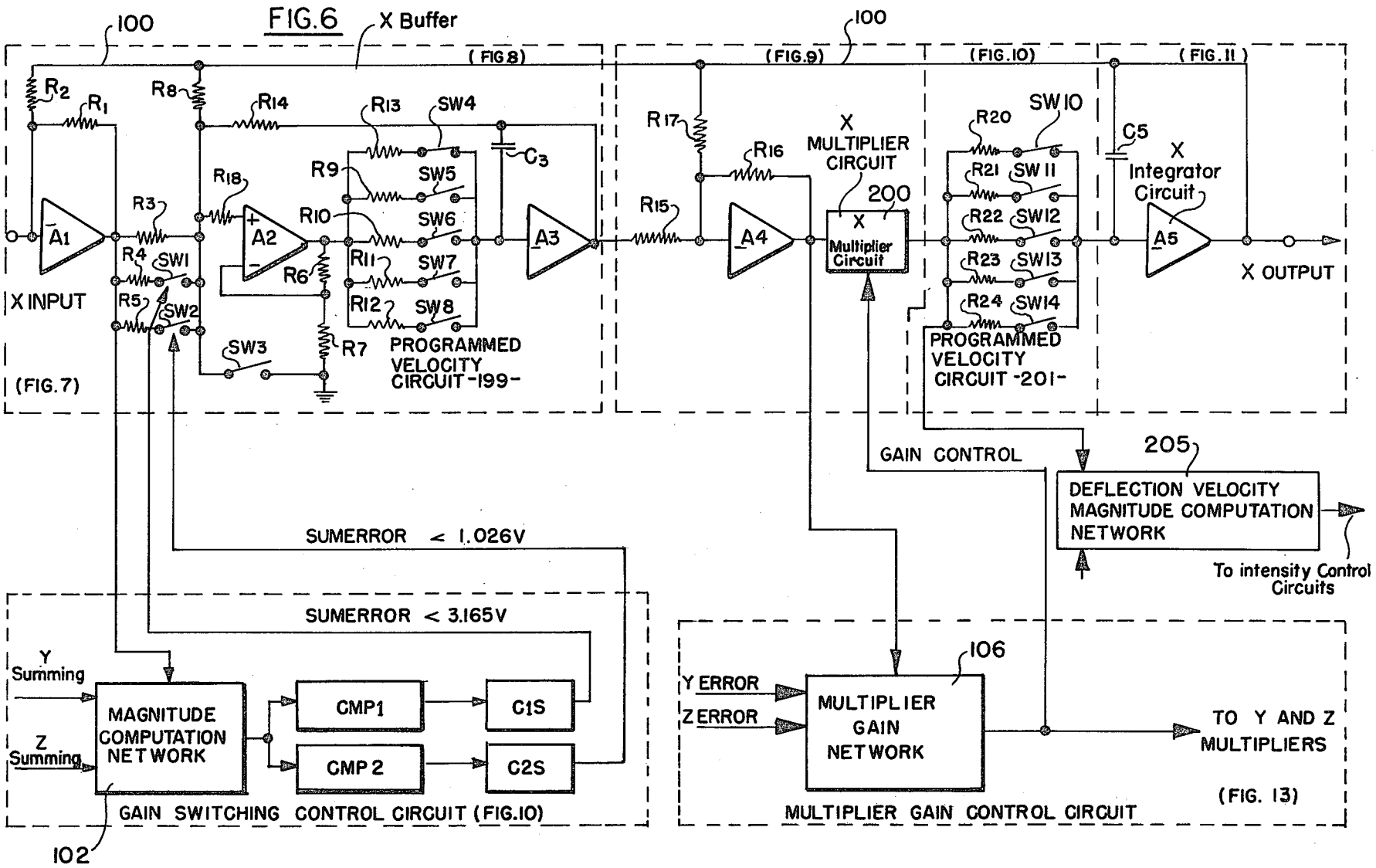
FIG. 6
X Buffer
X INPUT
(FIG. 7)
(FIG. 8)
(FIG. 9)
(FIG. 10)
(FIG. 11)
X OUTPUT
X Integrator Circuit
X MULTIPLIER CIRCUIT
PROGRAMMED VELOCITY CIRCUIT -199-
PROGRAMMED VELOCITY CIRCUIT -201-
GAIN CONTROL
DEFLECTION VELOCITY MAGNITUDE COMPUTATION NETWORK
To intensity Control Circuits
TO Y AND Z MULTIPLIERS
(FIG. 13)
MULTIPLIER GAIN NETWORK
MULTIPLIER GAIN CONTROL CIRCUIT
Y ERROR
Z ERROR
SUMERROR < 1.026V
SUMERROR < 3.165V
MAGNITUDE COMPUTATION NETWORK
CMP1
CMP2
C1S
C2S
GAIN SWITCHING CONTROL CIRCUIT (FIG. 10)
Y Summing
Z Summing
100
102
106
200
205

To FIG.8
AMPLIFIER -A3-
X FILTER
14R35
14C17
+15V
14C9
A-3
14C10
-15V
VELD 0*
VELD 1*
VELD2*
VELD3*
VELD4*
17R20
17R19
C3
+15V
-15V
PROGRAMMED VELOCITY CIRCUIT-199-
(TYP)
14U1
14U2
14R9
R14
R20
R21
R22
R23
R24
-15V
R8
14C6
14C7
AMPLIFIER -A2-
A-2
+15V
-15V
14R17
14R19
14R23
14CR7
14R34
R6
14C8
14R20
FROM FIG. 10
14R13
+15V
14R33
14R30
14R31
14R12
14Q1
14Q2
To FIG. 11
R3
14Q3
+5V
X BUFF
SW2
14CR6
14CR5
FROM FIG. 11
FROM FIG. 11
X SUMMING
14R32
-15V
R5
R4

R2
14C1
R1
14C2
14C3
A-1
-15V
14C4
14C5
+15V
14R4
X INPUT

+15V
13R23
13CR15
13Q4
13R27
13Q2
13CR10
13CR9
13CR18
13C8
13R20
13R29
13R13
13R35
+5V
13R26
13CR16
To FIG.7
To FIG.7
13Q5
-15V
13R31
13U10
+15V
13R28
13R22
13Q3
13CR12
13CR11
13R12
13CR19
+15V
13R19
13CR17
13C9
13R21
13CR20
13R32
13C14
-15V
13R34
13R25
13R30
+5V
13R33
13R18
13U1C
13U1A
13R10
+15V
13U1B
COMP2
+5V
COMP1
13R16
13C6
DACLOAD*
+15V
-15V
+15V
+5V
13C12
13R11
13R17
13R15
-15V
13R9
13R14
13Q1
-15V
+15V
13R8
13R7
-15V
Y SUMMING
13CR4
13CR8
+5V
13R6
13R5
13R1
13CR1

MAGNITUDE COMPUTATION NETWORK-102-
13CR5
13R2
+15V
-15V
FROM FIG.7 X SUMMING
13R3
13A1
13C5
13CR6
13CR3
+15V
13R4
13CR7
13CR2
ZSUMMING

+15V
25R15
25Q2
25C2
25R1
+10V
25R2
25CR1
25Q1
25R17
25CR5
GAIN CONTROL
To FIG. 8
25CR21
25CR4
25R16
25Q5
25R14
25R12
-15V
25Q6
25C6
25CR6
25R13
25R18
25R19
25R21
25C7
25CR7
25R31
25R22
25Q8
25R40
25R41
25R39
25R7
25VR2
25R20
25R32
25R33
25CR18
25Q10
25R30
MULTIPLIER GAIN CONTROL NETWORK -106-
25R38
25Q4
25R29
25Q3
25CR16
25C9
25R27
25R28
25CR15
25R25
25R26
25C8
25A1
25C11
25CR11
XERROR
25CR14
25R24
25R37
25R36
25CR10
25R35
25CR17
YERROR
25CR13
ZERROR
FROM FIG. 9
25R23
25CR12

VECTOR GENERATOR

BACKGROUND OF THE INVENTION

The vector generator described and claimed herein is of the same general type as described in U.S. Pat. No. 3,772,563. As described in the patent, cathode-ray tube circuits have been well known for many years for the graphic display of electrically computed information. Basically, in a cathode-ray tube, a stream of electrons is directed from an electron gun past two pairs of electrostatic deflection plates towards a phosphorized screen. The point at which the electron beam formed by the stream of electrons impinges on the screen is temporarily illuminated. The two pairs of deflection plates control the position of the resulting illuminated spot on the screen. The deflection of the illuminated spot from the center of the screen depends upon the magnitude of the voltage applied across the deflection plates. One pair of deflection plates controls the deflection of the electron beam vertically in the Y-direction, and the other pair of plates controls the deflection horizontally in the X-direction. Simultaneously, the two pairs of plates can direct the electron beam to impinge on any point within the range of the screen, and predetermined voltage levels across the horizontal and vertical deflection plates correspond to definite X- and Y-coordinate positions of the illuminated spot on the screen.

One commonly used method of the prior art to display a vector line on the screen of a cathode-ray tube is carried out as follows. Assuming the location of the vector origin point at coordinates $X_1$, $Y_1$, and of the vector end point at coordinates $X_2$, $Y_2$, the length of the vector R is first computed according to the equation:

$$R = [(X_2 - X_1)^2 + (Y_2 - Y_1)^2]^{\frac{1}{2}} \quad (1)$$

The aforesaid computation can be accomplished by applying the given quantities to an analog-to-digital converter, performing the calculation by digital methods to the desired degree of precision, and by then restoring the result to analog form by a digital-to-analog converter. From the length R of the vector, the time T(R) to draw the vector is also computed. The time interval T(R) is a function of the length R of the vector and of the speed of the moving illuminated spot.

Next, in accordance with the prior art method, the coordinate positions of the moving spot as a function of time "t" are determined, according to the following equations:

$$x(t) = \left[\frac{(X_2 - X_1)}{T(R)}\right] \cdot t + X_1 \quad (2a)$$

$$y(t) = \left[\frac{(Y_2 - Y_1)}{T(R)}\right] \cdot t + Y_1 \quad (2b)$$

The aforesaid computations are accomplished by computing circuits using a ramp function, whereby the slope and linearity of the ramp must be accurately controlled. It becomes apparent to those skilled in the art that the computing circuits involved in the aforesaid prior art method, and which include digital-to-analog and analog-to-digital converters, digital computers, and precision ramp function generators, involve a considerable number of circuit components with precisely controlled values; and that such prior art circuits further require provisions for calibrations and adjustments to compensate for unavoidable variations in component values, and for changes of component values under the influence of time and environment.

Unlike the prior art system referred to above, which requires the control of several separate parameters to a high degree of precision, the improved system described in the prior patent requires the accurate control of only one parameter, namely, the matching of two time constants in an exponential voltage rise function. This parameter governs the ratio between the horizontal and vertical components of the vector being drawn. In addition, the system described in the prior patent can be constructed with fewer and less expensive components than the previous prior art system, and it requires fewer calibrations and adjustments.

A principal objective of the system described in the prior patent, therefore, is to provide an improved system capable of representing vectors in an improved manner, as compared with the previous prior art systems. This is achieved in the system of the patent by accurately controlling but a single computation parameter and by the use of considerably fewer components than the previous prior art system. Moreover, the system of the patent has fewer calibration requirements than the earlier prior art systems.

Briefly stated, the system described in the prior patent provides a vector generator for generating a straight line from one point to another point on the screen of a cathode-ray tube. The vector generator holds the previous input point and generates a straight line between that point and the new input point. Three inputs to the cathode-ray tube system are required: one for horizontal deflection, one for vertical deflection and the third for instensity control. In previous prior art vector generators, as described above, the vectors are drawn after all of the vector parameters are first computed, and several steps are required. First, the difference between the present and the previous input vector end points must be obtained for both the horizontal and vertical deflection. Second, the time to draw the vector, the required velocity in both the horizontal and vertical directions and the intensity level must be selected. Third, the vector is drawn using the parameters selected. The vector drawing spot arrives at the new point in the previous prior art systems within the accuracy of the several computations required. To insure accurate vector end points the end point difference computation, the drawing rate, and the drawing time must all be highly accurate in the previous prior art systems. Specifically, an accuracy of 0.1% is generally necessary for good visual appearance. Precision intensity level is not necessary, because as much as 10% change of intensity cannot be detected by the eye. The vector generator of the prior patent reduces the precision requirements and cost. Vector drawing time is also reduced because less computation at lower accuracy is required to generate a vector visually as acceptable as one generated by the previous prior art systems.

The vector generator of the present invention involves certain improvements over the system described in the prior patent. Specifically, electronic component requirements are reduced with a corresponding reduction in adjustment requirements and greater stability; the drawing time for short vectors is reduced; the drawing rate is readily programmable; and the output of the vector generator is held constant with time if vector drawing is terminated.

BRIEF DESCRIPTION OF THE DRAWINGS

FIG. 6 is a block diagram of one embodiment of the invention;

DETAILED DESCRIPTION OF THE ILLUSTRATED EMBODIMENTS

Figure 1:
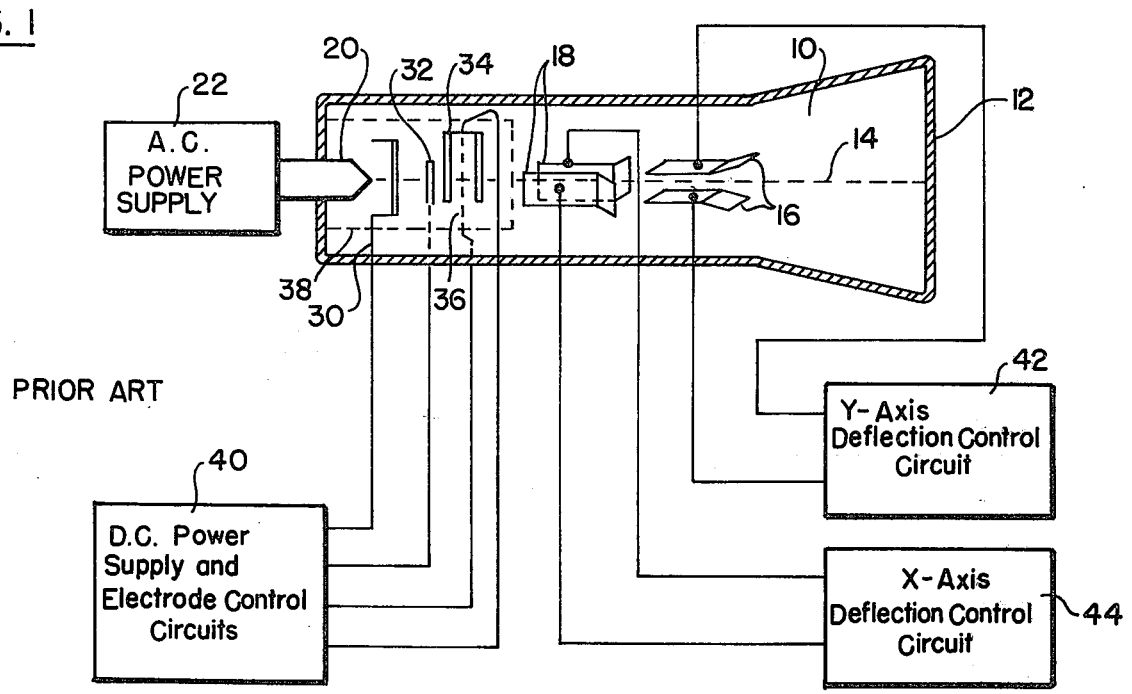
FIG. 1 is a simplified diagrammatic representation of a cathode-ray tube and its controlling circuitry.

Referring now to FIGS. 1–5 of the drawings, wherein like characters designated like or corresponding parts, there is illustrated in FIG. 1 a schematic diagram of a tyypical cathoderay tube 10. At the face of the cathode-ray tube 10 there is a phosphorized screen 12, on which an electron beam 14 is made to impinge. The electron beam 14 passes between a pair of vertical deflection plates 16, and a pair of horizontal deflection plates 18. The voltage across the vertical deflection plates 16 is controlled by the Y-axis control circuits 42, while the voltage across the horizontal deflection plates is controlled by the X-axis control circuits 44.

The electron beam 14 emerges from an electron gun 38, the detailed construction of which varies with the various cathoderay tube manufacturers. In most cases, the electron gun 38 contains a filament 20, a heated cathode 30, a control grid 32, an isolating electrode 34, and an accelerating electrode 36. The filament is supplied with electric current from an alternating current power supply 22. A direct current power supply and control circuits for the various electrodes of the gun are represented by the block 40. The detailed construction of the power supply circuits 22 and 40 is well known to those skilled in the art and, for that reason, will not be described in detail herein. The following discussion will relate primarily to the X-axis and Y-axis deflection control circuits 42 and 44.

Figure 2:
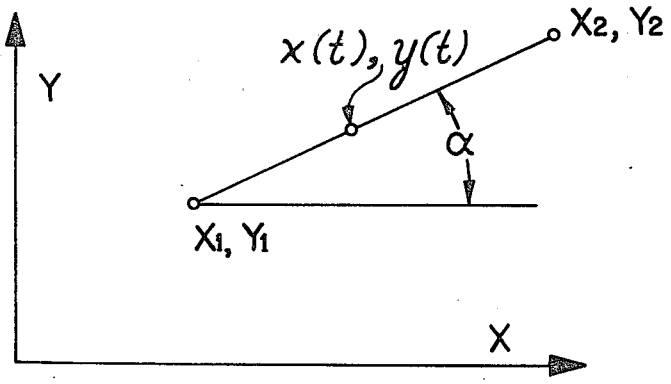
PRIOR ART FIG. 2
FIG. 2 is a vector diagram relating to the circuit elements discussed in the explanation of the invention.

Referring now to the vector diagram shown in FIG. 2, the starting point of the vector is given by the coordinates $X_1$ and $Y_1$, while the end point is given by the coordinates $X_2$ and $Y_2$. The illuminated spot on the screen 12 of the cathode-ray tube of FIG. 1 is moved between the starting point and the end point in order to trace out the vector. The end point of one vector may serve as the starting point for a succeeding vector.

If the illuminated spot is contrrolled to trace the path of a straight line, it is necessary that at any instant $t$ the coordinates $x(t)$ and $y(t)$ conform to the relation:

$$\left[\frac{Y_2 - y(t)}{X_2 - x(t)}\right] = \left(\frac{Y_2 - Y_1}{X_2 - X_1}\right) = \tan\alpha \tag{3}$$

Figure 3:
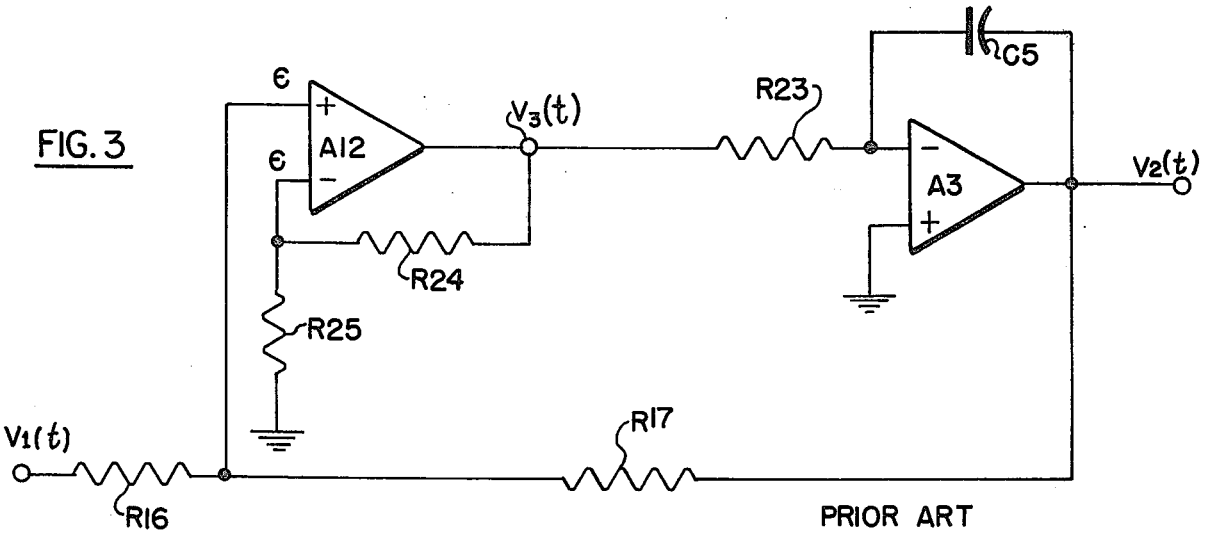
FIG. 3 is a schematic diagram of an explanatory elementary circuit used to illustrate the principle underlying the vector generator of the invention.

For a better understanding of the basic principles involved in the practice of the present invention, a simplified version of a deflection control circuit is shown in FIG. 3. Since the same mathematical principles are involved in a construction of the Y-axis and X-axis deflection control circuits 42 and 44, expressions for voltages are substituted in conjunction with the circuit of FIG. 3, and in the following mathematical analysis for the expressions containing the coordinate points.

The simplified deflection control circuit of FIG. 3 may be included, for example, in the Y-axis deflection control circuit 42, or in the X-axis deflection control circuit 44 of FIG. 1. The simplified circuit of FIG. 3 includes an input terminal designated $V_1(t)$ which is connected to a resistor R16. The resistor R16 is connected to the positive input terminal of an operational amplifier A12. The negative input terminal of the operational amplifier A12 is connected to a grounded resistor R25. The output terminal of the operational amplifier designated $V_3(t)$ is connected back to the negative input terminal through a resistor R24, and is also connected through a resistor R23 to the negative input terminal of an integrating operational amplifier A2. The positive input terminal of the operational amplifier A2 is grounded. The output terminal of the operational amplifier A3 is coupled back to the negative input terminal through a capacitor C5, and is connected through a resistor R17 to the positive input terminal of the operational amplifier A12. The output of the operational amplifier A3 is connected to an output terminal designated $V_2(t)$.

In the circuit shown in FIG. 3, the input voltage applied to the input terminal $V_1(t)$ is a step function corresponding to $(Y_2 - Y_1)$ or $(X_2 - X_1)$ in equation (3). The voltage at the output terminal $V_2(t)$ may represent the expression $(Y_2 - y(t))$ or $(X_2 - x(t))$ in equation (3). It can be shown from the basic theory of operational amplifiers that the voltage appearing at the output terminal $V_3(t)$ of the operational amplifier A12 may be defined by the equation:

$$V_3(t) = \epsilon\left(1 + \frac{R_{24}}{R_{25}}\right) \tag{4}$$

where: E is the expression for the error voltage.

Furthermore, the integrating operational amplifier A3 relates the voltages $V_2(t)$ and $V_3(t)$ by the integral expression:

$$V_2(t) = \frac{-1}{C_5 \cdot R_{23}} \quad V_3(t)\,dt + V_{20} \tag{5}$$

where: $V_{20}$ is initial value of $V_2$.

If the values for the resistors R16 and R17 are made equal, then the following expression for the error voltage may be obtained:

$$\epsilon = \left[\frac{V_1(t) + V_2(t)}{2}\right] \tag{6}$$

Substituting the expression for E of equation (6) into equation (4), the following expression is obtained:

$$V_3(t) = [V_1(t) + V_2(t)] \cdot \frac{1}{2}\left(1 + \frac{R_{24}}{R_{25}}\right) \quad (7)$$

Replacing the expression for $V_3(t)$ of equation (7) in equation (5), the following expression is obtained:

$$V_2(t) = \frac{1}{2(C_5)\cdot(R_{23})} \cdot \left(1 + \frac{R_{24}}{R_{25}}\right) [V_1(t) + V_2(t)]\, dt + V_{20} \quad (8)$$

The expression outside the integral sign of equation (8) can be lumped into a single constant whose value is determined by the values of the resistors R23, R24 and R25, and of the capacitor C5. That constant may be indicated as $1/T_1$. Further development of equation (8) then yeilds the integral equation:

$$\frac{1}{T_1}\int V_1(t)\, dt = -V_2(t) - \frac{1}{T_1}\int V_2(t)\, dt + V_{20} \quad (9)$$

$V_1$ is a step function, so that $V_{11}$ may be substituted for the value $V_1$ before time zero, and $V_{12}$ may be substituted for the value $V_1$ after time zero. By Laplace transformation, the solution to equation (9) is as follows:

$$V_2(t) = (V_{12} - V_{11})e^{\frac{-t}{T_1}} - V_{12} \quad (10)$$

If the voltage levels are now translated back into the expressions for the X- and Y-coordinates, the following equations are obtained for the vertical and horizontal deflection control circuits respectively:

$$[Y_2 - Y(t)] = (Y_2 - Y_1)e^{\frac{-t}{T_1}} \quad (11a)$$

$$[X_2 - X(t)] = (X_2 - X_1)e^{\frac{-t}{T_1}} \quad (112b)$$

If the ratio between the expression (11*a*) and (11*b*) is taken, the relation shown in equation (3) is obtained. As long as the time constant $T_1$ is the same for the vertical and horizontal deflection control circuits, the exponential terms in the ratio cancel out, and the spot on the screen will follow a straight line, although the voltage in each deflection control circuit is an exponential function of time.

Thus, it is obvious that in order to obtain an accurate trace of the vector on the screen in the system of the invention it is only required to match the component values in the vertical and horizontal deflection circuits. This task is considerably easier and less complex than the multiple adjustments and calibrations required in the prior art systems.

Figure 4:
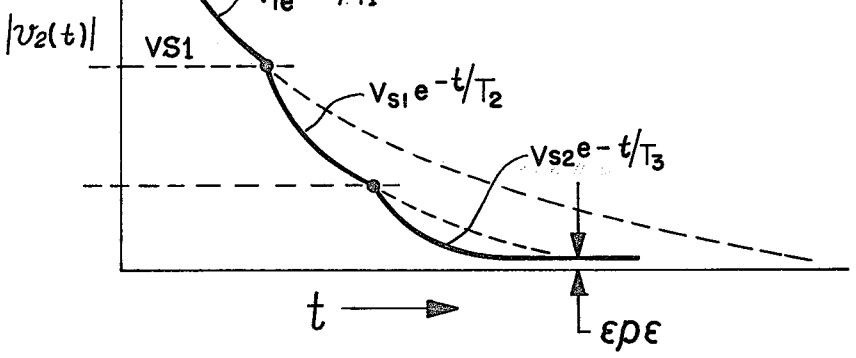
FIG. 4 is a time-voltage diagram, illustrating the effect of changes in the effective time constant of the exponential function during a vector stroke, in the operation of the system of FIG. 3.

It is preferable to change the effective time constant of the deflection circuits during the vector stroke, as is made clear by reference to the curve of FIG. 4. In the diagram of FIG. 4, the difference between the voltage across the corresponding deflection plates of the cathode-ray tube at any given instant "*t*", and the desired end point voltage is plotted as an exponential function, originally with the starting time constant $T_1$. If the same time constant $T_1$ were to be maintained for the entire vector stroke, the time to reach an acceptable end point error voltage EPE would take too long, as may be deduced from the path of the extension of the initial curve shown as a broken line in FIG. 4. At a given predetermined switching voltage level $V_{S1}$, switching elements in the system are actuated, as explained in the prior patent, so that a new time constant $T_2$ becomes effective. This new time constant $T_2$ governs the voltage-time relationship until the next voltage switching level $V_{S2}$ is reached, creating a new time constant $T_3$.

Although only two distinct switching voltage levels are shown in the diagram of FIG. 4 in order to facilitate the explanation of the system, it is apparent that with a selected number of switching gates, a corresponding number of different time constants may be derived. Therefore, the average slope of the voltage-time curve, which at the same time represents the velocity of the illuminated spot across the screen 12 of the cathode-ray tube 10 of FIG. 1, can be controlled, with the speed being increased when the end point error voltage EPE has been reduced to an acceptable level.

The switching operations are made simultaneously in both the X- and Y-deflection circuits, so that the identical time constant is used in both the X-axis and Y-axis deflection control circuits at any instant. In this way, the constant ratio between the horizontal and vertical component of the vector is maintained according to the relationship set out in equation (3).

As the curve in FIg. 4 approaches the point of acceptable end point error voltage EPE, the slope of the curve also approaches a zero value which tends to produce an asymptotic relationship. This slope, representing the trace velocity is given by the expression $dV_2(t/dt$. Referring again to equation (5), we note that a differential of both sides of the equation yields the equation:

$$\frac{dV_2(t)}{dt} = \frac{-1}{C_5 \cdot R_{23}} \cdot V_3(5) \quad (12)$$

Thus, by simply monitoring the voltage level at $V_3(t)$, it is possible to determine when the trace velocity has reached the predetermined minimum acceptable level, and when the end point has been reached within the limits of the desired accuracy. This represents a distinct advantage over the prior art systems, in which complex computations are made by complex circuitry to determine the end point of the vector.

In the system of FIG. 4, as soon as the value of $V_3(t)$ has reached the minimum acceptable level, the end point signal is generated.

As the slope of the curve in FIG. 4 changes at the various switching points, the speed at which the cathode-ray beam is swept across the screen changes, so that the illumination intensity of the spot also changes. However, since the average slope of the curve is held within reasonable limits during the trace of the vector, the variation in illumination intensity is not serious. This variation can be easily held in within 10%, and such intensity fluctuation does not seriously affect the image observed by the human eye. Appropriate controls may be introduced to the D.C. power supply 40 of FIG. 1 to compensate for the changes in illumination intensity, if so desired, for example, control circuits of the type described in U.S. Pat. No. 2,860,284 may be used for this purpose. In any event, it is the position of the illuminated spot at any instant of the trace which is the critical parameter, and which is precisely controlled by the system of the invention.

Figure 5:
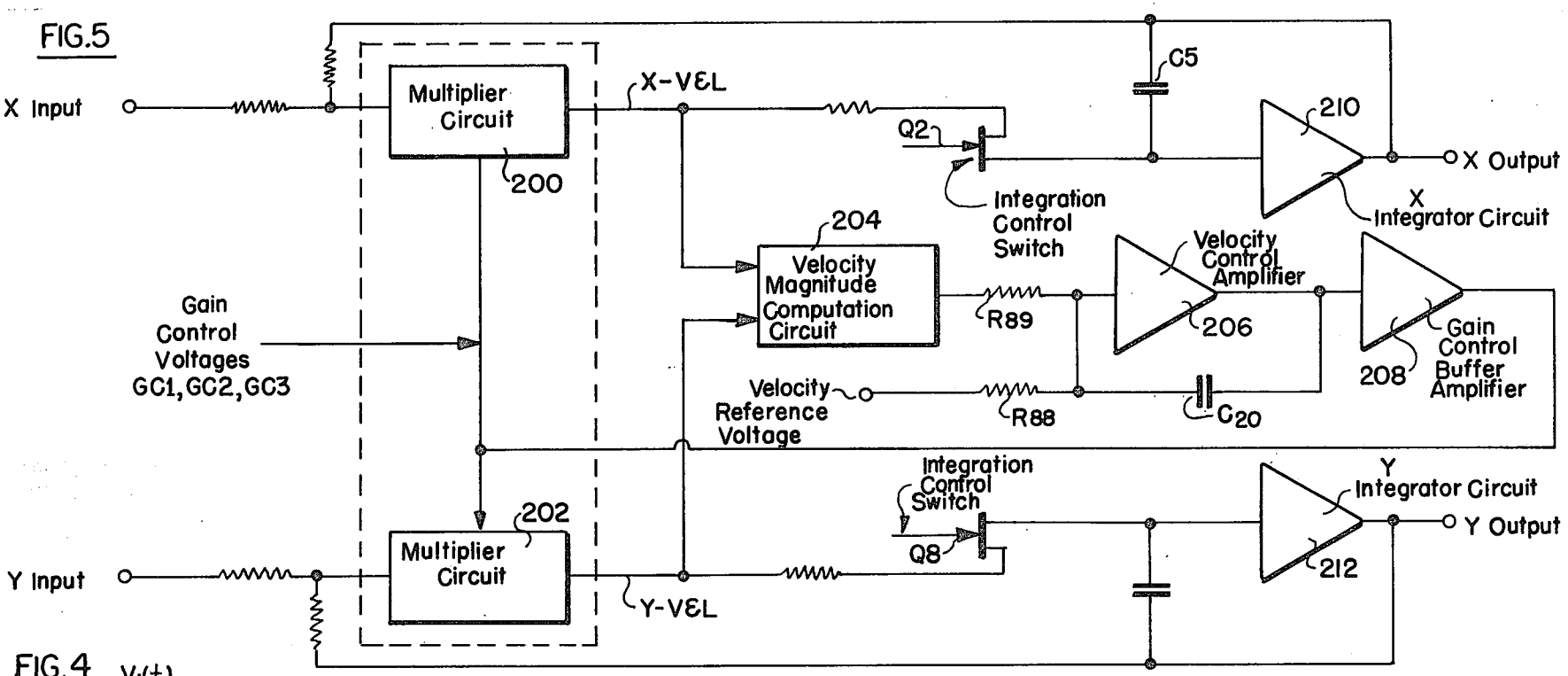
FIG. 5 is a block diagram of a vector generator in which the time constant of the system is changed in an infinite resolution manner.

In the curves of FIG. 4 the time constant in the corresponding system is switched at discrete points as described above. In the system of FIG. 5, however, the time constant changes in an infinite resolution system which may be likened to that of replacing a switched attenuator with a potentiometer.

The system of FIG. 5 includes a first multiplier circuit 200 and a second multiplier circuit 202. The X input is applied to the multiplier 200, and the Y input is applied to the multiplier 202. The outputs $X_{VEL}$ and $Y_{VEL}$ of the two multipliers are applied to a velocity magnitude computation circuit 204, the output of which is applied to a velocity control amplifier 206. The multipliers 200 and 202 and the circuit 204 and the amplifier 206 are all described in circuit detail in the prior patent. The output of the velocity control amplifier 206 is introduced to a plurality of gain control buffer amplifiers 208 whose gain control voltage outputs GC1, GC2 and GC3 are fed back to the multiplier circuits 200 and 202.

The outputs of the multipliers 200 and 202 also apply to respective integrator circuits 210 and 212 through field effect transistor switches Q2 and Q8. The X output appears at the output of the integrator circuit 210, whereas the Y output appears at the output of the integrator circuit 212. As in the previous embodiment, the X output is applied to the X-axis deflection control circuit of the cathode-ray tube, whereas the Y output is applied to the Y-axis deflection control circuit.

The multiplier circuits 200 and 202 and in the X and Y channels of the system of FIG. 5 serve as tracking, variable gain elements which continuously adjust the time constant of the two channels. The remaining components of the two channels are matched, and since the two multiplier circuits 200 and 202 track, both channels always have the same time constant at any instant of time, and, therefore, will generate a straight line vector in accordance with the previous discussion.

The system of FIG. 5 provides a time constant control loop which consists of the multiplier circuits 200 and 202, the velocity magnitude computation circuit 204, the velocity control amplifier 206, and the gain control buffer amplifiers 208. This time constant control loop serves to maintain the X or Y component of spot velocity of the cathode-ray tube constant. The output voltage from the velocity magnitude computation circuit 204 is the magnitude $X_{VEL}$ or $Y_{VEL}$ whichever is largest. At the node of the velocity control amplifer 206, a summing network compares the output of the velocity magnitude computation control circuit 204 with a reference voltage to provide an error signal proportional to the difference. The error signal is integrated by the velocity control amplifier to provide a gain control voltage to the buffer amplifiers 208 which feed resulting gain control voltages to the multiplier circuits 200 and 202.

The operation of the time constant control loop is such that if the amplitude of $X_{VEL}$ or $Y_{VEL}$ decreases because of a decrease in the amplitude of the voltage at the multiplier signal input, an error signal at the input of the velocity control amplifier 206 increases in amplitude and causes a corresponding increase in the gain control voltage applied to the multipliers 200 and 202, thereby to increase the amplitude of the voltages $X_{VEL}$ and $Y_{VEL}$ towards their normal value.

The vector is drawn from the last end point location held in the vector integrator circuits 210 and 212 to a new end point location by first applying the new end point signals to the multiplier circuits 200, 202, as designated X INPUT and Y INPUT in FIG. 5. The integration control switches Q2 and Q8 are closed when the time V BUSY-VG goes true setting in NVEND and vector generation begins. As the vector is drawn, continuous control of the vector velocity is provided by the gain control circuits until maximum multiplier gain is reached. Vector velocity now decreases towards zero on a time and constant curve. When the amplitude of the vector velocity signal decreases to approximately 0.5 volts, and after a particular time delay, the switches Q2 and Q8 are opened.

The output of the velocity control amplifier 206 is fed to three differential gain control buffer amplifiers, as represented by the block 208 in FIG. 5. These buffer amplifiers respectively supply the gain control voltages GCl, GC2 and GC3 to the multiplier circuits 200 and 202. The differential gain control buffer amplifiers have an output range, limited, for example, to plus or minus 4-volts. The negative inputs of all the gain control amplifiers are connected together but their positive inputs are biased to levels of 0.2 volts apart. Therefore, only one of the gain control buffer amplifiers is active at a time, while the outputs of the other two buffer amplifiers are clamped at ± 4 volts.

In the system of FIG. 5, the time constant, instead of being changed at discrete points, as in the case shown in FIG. 4, is changed continuously as each vector is drawn.

In the circuit of FIG. 6, a current source representing the X INPUT is connected to the negative input terminal of an operational amplifier A1. The output terminal of amplifier A1 is connected back to the input terminal through a 5 kilo-ohm feedback resistor R1, and is also connected to an X BUFFER feedback lead 100 through a 10 kilo-ohm resistor R2. The feedback lead 100 is connected to the output terminal X OUTPUT of the system. The output terminal of amplifier A1 is also connected to a 30 kilo-ohm resistor R3, a 15 kilo-ohm resistor R4 and a 3.32 kilo-ohm resistor R5. The resistors R4 and R5 are connected to respective switches SW1 and SW2, and resistor R3 and the two switches are connected through a 1 kilo-ohm resistor R18 to the positive input terminal of an operational amplifier A2. The output terminal of amplifier A2 is connected to a resistor R6 which, in turn, is connected to a grounded resistor R7. The junction of resistors R6 and R7 is connected back to the negative input terminal of amplifier A2. A hold switch SW3 is connected from the junction of resistors R3 and R18 to ground. The junction is also connected to the X output lead 100 through a 5 kilO-ohm resistor R8.

The output of the amplifier A2 is connected to a series of resistors R13, R9, R10, R11 and R12, and these resistors are connected through switches SW4, SW5, SW6, SW7 and SW8 to the negative input of an amplifier A3. The output terminal of amplifier A3 is connected back to the input terminal through a capacitor C3, and is connected through a 5 kilo-ohm resistor R14 to the junction of resistors R3, R18 and R8.

The output terminal of amplifier A1 is also connected to a magnitude computation network 102 which receiveS Y SUMMING and Z SUMMING signals, and whose output terminal is connected to a pair of comparator networks designated CMP1 and CMP2. The output terminal of network CMP1 is connected through a network C1S to close switch SW1 when the sum error is less than 3.165 volts, and network C2S is connected to switch SW2 to close the latter switch when the sum error is less than 1.026 volts.

The output of amplifier A3 is connected through a 2 kilo-ohm resistor R15 to the negative input terminal of an operational amplifier A4. The output terminal of amplifier A4 is connected back to the negative input terminal through a 6 kilo-ohm feedback resistor R16. The negative input terminal of the amplifier is also connected through a 2 kilo-ohm resistor R17 to the X OUTPUT lead 100. The output terminal of amplifier A4 is also connected to the multiplier circuit 200 whose output terminal is connected to a series of resistors R20, R21, R22, R23 and R24. The resistors, in turn, are connected through respective switches SW10, SW11, SW12, SW13 and SW14 to the negative input terminal of the integrator amplifier A5. The output terminal of amplifier A5 is connected to the X OUTPUT terminal, and is also connected back to the negative input terminal through capacitor C5.

It will be understood that the circuit of amplifiers A1, A2, A3, A4 and A5 is incorporated into the X channel of the system, and that a similar amplifier is included in the Y channel.

The amplifier A4 supplies an X ERROR signal to a multiplier gain control circuit 106. The multiplier gain control circuit also receives a Y ERROR signal from the Y axis deflection circuit, a Z ERROR signal from the Z axis circuit, and a MOVE signal. The output of the multiplier gain control circuit is connected to the multiplier 200, and to similar multipliers in the Y and Z circuits.

The circuit of FIG. 6 illustrates the signal slow from the X INPUT terminal through the amplifiers A1, A2, A3 and A4, and through the multiplier 200 to the X integrator A5 which provides the final X deflection voltage for the cathode-ray tube. The integrator output is also fed back to the nodes of the three operational amplifiers A1, A2 and A4 to provide a closed-loop configuration for integrator time constant control. The circuit is constructed to generate a constant ± 5 volt output from multiplier 200 during the vector draw by varying the amplifier gains and the multiplier gain factor. This provides a constant current source for integrator A5 with resulting linear integration until near the end of the vector draw. At that time the multiplier output drops towards zero while the vector velocity of the cathode-ray tube beam decreases to zero on a time constant curve.

In the system of FIG. 6, constant vector velocity is achieved by using both continuous and switched gain control means. Switches SW1, SW2 and SW3; amplifiers A1, A2 and A3; and the associated components provide the switched gain steps. The multiplier circuit; amplifiers A4 and A5; and associated components provide the continuous gain interpolation. Switches SW4, Sw5, SW6, SW7, Sw8, Sw10, SW11, SW12, SW13 and SW14 are used to change the output drawing velocity for drawing on different output devices such as a refreshed monitor or storage tube monitor. These switches are generally only changed when the vector generator is not drawing.

Figure 7:
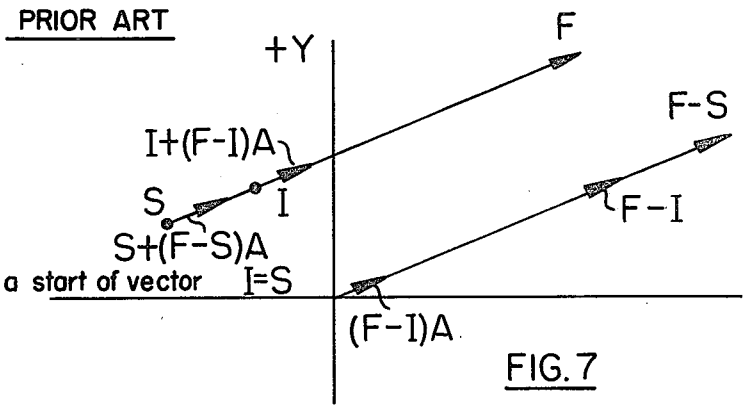
FIG. 7 is a vector diagram showing the vector voltages as they appear at various locations in the system of FIG. 6 at a given moment in time.

FIG. 7 is a vector diagram showing the vector voltages as they appear at various locations in the system at one particular instant in time.

Let I = voltage at X out to monitor = instantaneous output position signal

F = final X out voltage when vector is complete

A = gain from X out to the output of A3

S = voltage at X out at beginning of vector draw.

The general vector to be drawn is from S to F on the vector diagram. The subtraction F - I is performed at the input of A1. F – I is a new vector always with the same direction as the original vector but with the starting end at the origin. At the beginning of the draw F – I is also equal to F – S.

Since the starting end of F – I is at the origin, the vector may be multiplied by a number less than 1 to get a new vector with the same direction as F – I but with less magnitude. This new vector is (F – I)A on the vector diagram.

If this new vector is translated by adding I, it will be positioned back on the original vector with the same direction but with less magnitude than the original vector. The continuous gain interpolation circuits draw this new shortened vector. Less gain range is needed by the continuous gain interpolation circuits since the full scale vector never appears at the output of A3.

In the implemented apparatus the dynamic range of the multiplier is 8:1. When drawing a vector, the value of A must be switched to increase the dynamic range of the vector generator without increasing the dynamic range of the multiplier. Increasing the multiplier dynamic range would cause undesirable side effects of reduced accuracy and bandwidth.

The particular apparatus implemented switches A to 1 as I approaches F before the end of the vector. This provides additional advantages. The output of A3 is – I - (F – I)A and if A is 1 this becomes –F, a fixed value that does not change as the rest of the vector is drawn. The only circuits settling to final value at the end of vector are the output variable gain loop and amplifier A1. The loop consisting of A2 and A3 settles to its final value well before the output loop settles to the end of vector value. Fast settling of the output loop results.

The filter loop consisting of A2 and A3 is necessary to smooth the step changes caused by the switch closing at the input of A2 and thereby enable the variable gain output loop to follow the changes and keep the vector velocity constant.

The vector drawing process may be explained by referring to FIG. 6. First, switch SW3 is closed to connect the positive input terminal of A2 to ground. The output of A2 will also go to ground potential as a result and no current will flow through the selected resistor (one of the resistors R9 through R13) into the capacitor C3. The current at the input terminal of A2 is always negligible. Since no current flows through capacitor C3, the output of A3 will not change as long as switch SW3 is closed. Now, while SW3 is closed, the X input current is applied allowing SW1 and SW2 to assume their proper condition by the action of the gain switching control circuit. After all transients have dissipated, switch SW3 is opened allowing the vector drawing process to begin. Capacitor C3 will charge due to current flowing through the selected resistor and, therefore, the output of A3 will change. Feedback through resistor R14 causes the output of A3 to approach –(F – I)A – I as explained previously.

As the vector drawing process continues, the magnitude of the voltage at the output of A1 will decrease and, assuming a vector of long length is being drawn, CMP1 will signal that SW1 should close. Prior to closing SW1, however, SW3 will be closed to inhibit the switching transient caused by SW1 closing. The design of SW3 is such that when it opens or closes it does not inject significant error signals (switching spikes) into the input of A2. Switches SW1 and SW3 are not so designed and therefore must change states only when SW3 is closed. SW3 now opens to allow the A3 output to change. Note that the vector drawing process continued while SW3 was closed. Closing SW3 caused the output of A3 to stop changing but, since the X OUTPUT had not yet reached the negative of the value at A3 output, the output drawing process continued.

Switch SW3 will close in the same manner as described above for SW1 and finally the vector end point will be approached. A comparator circuit detects when the sum of the magnitude of all the multiplier outputs are near zero. The comparator output signal then tells the vector generator control logic that the vector is complete and that a new one may begin. It should be noted that since the integrator A5 is not switched out of the circuit between vector draws, integrator drift and consequent deflection voltage drift is prevented even though the vector generator circuit is not actually in use.

Referring again to FIG. 6, the output continuous gain interpolation circuit containing amplifiers A4 and A5 and the multiplier circuit is similar to the vector generator described in U.S. Pat. No. 3,772,563 except for several important differences. First, the circuit of FIG. 6 has a limited gain range: 8 to 1 instead of 64 to 1 as in the previous patent. Second, the new circuit can be adapted readily to draw at different velocities by merely changing the selected resistor at the input of the integrator. Third, the multiplier gain control metwork of the present invention operates on a different principle. Instead of a closed loop system operating to maintain the magnitude of the largest multiplier output signal at a constant value, the new system is an open loop wave shaping circuit that generates the proper gain control signal from the magnitude of the largest input signal to the multiplier.

The advantage here is one of response time. The signals out of amplifier A3, although smoothed by the action of C3, still cause fast moving waveforms at the multiplier output after being multiplied by the gain of the amplifier A4 and the multiplier gain. Any non-linear limiting will cause errors in the vector being drawn, and therefore the multiplier gain must be reduced before output saturation occurs. In the old system, an actual change in the multiplier output must be sensed by the control loop before gain correction can occur. The new gain control system senses the signal change before the multiplier input receives the change, thus allowing the gain reduction to occur earlier as required.

The total gain of amplifiers A1, A2 and A3 varies from a minimum of 1/12 when I - F is maximum, to a maximum gain of 1 when I - F is minimum. Amplifier A1 has a gain of one-half as noted above, and its output may range from 0 volts at vector end time when $I = -F$, to a maximum of $\pm$ 10 volts at the instant a full scale draw is specified, when $I = +10$ volts and $-F = -10$ volts, or $I = 10$ volts and $-F = +10$ volts. When any of the X, Y or Z summing signals applied to the magnitude computation network 102 exceeds $\pm$ 3.175 volts, both switches SW1 and SW2 (which may be field effect transistors) controlled by C1S and C2S are opened, and current flow to the node of operational amplifier A2 is through resistor R3 resulting in a gain of 5k/30k or 1/6. When the largest of the three summing voltages drops below 3.17 volts, the switch SW1 closes to parallel resistor R4 with resistor R3. This results in a circuit gain of 5k/10*k* or 1/2. Finally, when the largest of the three summing voltages drops below 1.36 volts, the switch SW2 closes and the gain becomes 5*k*/2.5*k* or 2.

The output from amplifier A3 is —I —(F—I)A is the gain from the X OUTPUT terminal to the output of amplifier A3. The output of integrator A5 is summed at the node of the amplifier A4 with the output of amplifier A3 to provide an input to amplifier A4 which is as follows:

$$+I-I-(F-I)A = -(F-I)A \ldots . \quad (13)$$

After inversion by amplifier A4, the multiplier input voltage then becomes (F–I)A $\times$ 3. This latter voltage, together with the gain control voltage derived from the multiplier gain control network 106 holds the multiplier output at $\pm$ 5 volts for vector draws as long as the multiplier input (F–I)A $\times$ 3 exceeds $\pm$ 0.625 volts. For values below this level, the multiplier output becomes eight times (F–I)A $\times$ 3.

The various components which make up the system of FIG. 6 are shown in more detail in FIGS. 8–13. It will be understood that FIGS. 6–13 represent the X channel of the system, and that the Y channel will contain similar circuitry.

Figure 8:
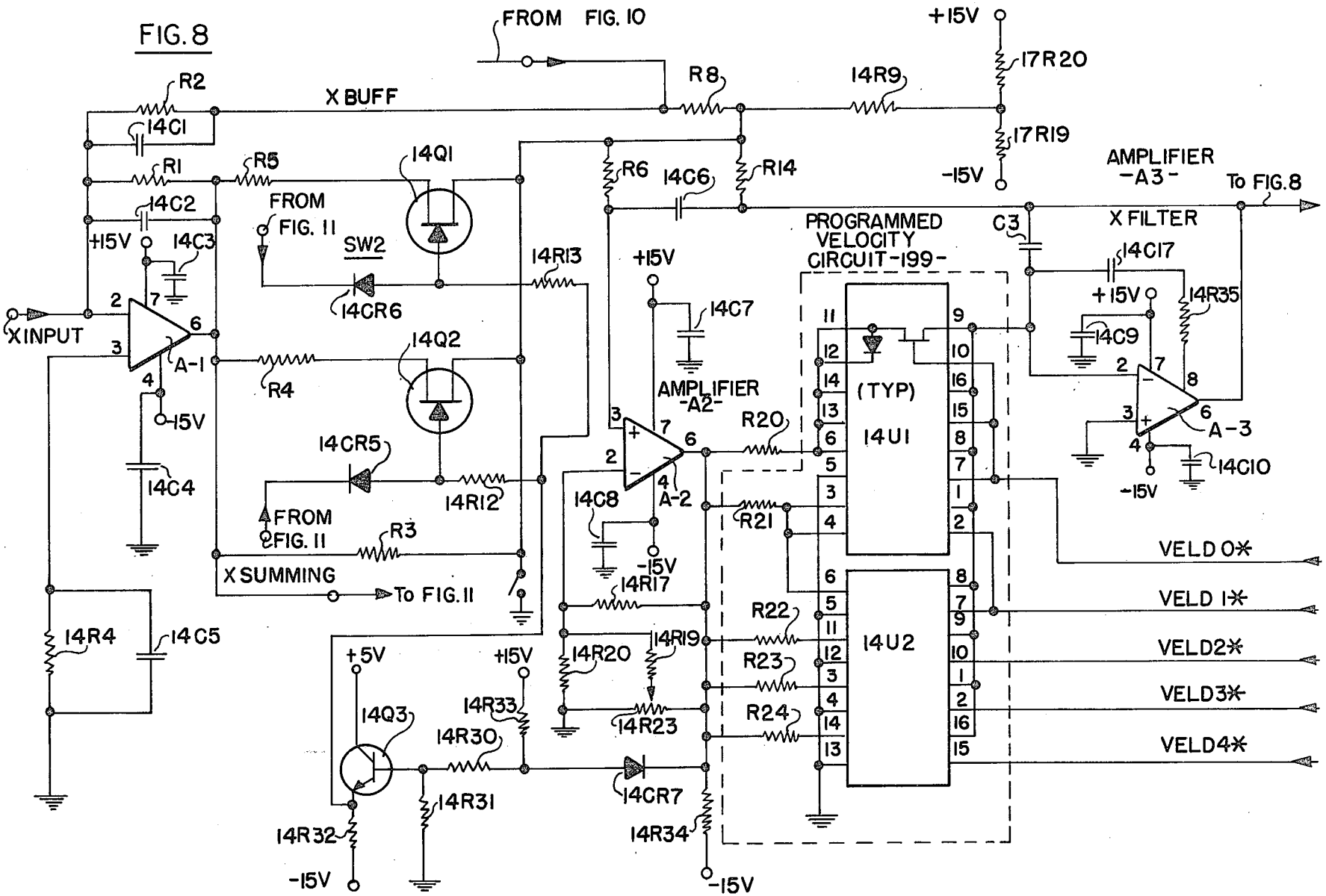
FIGS. 8–13 are more detailed circuit diagrams of the various components which make up the system of FIG. 6.

The amplifiers A1, A2 and A3, and the programmed velocity circuit 199, and associated circuitry of FIG. 6 are shown in greater detail in FIG. 8. As shown in FIG. 8, the X INPUT is introduced to the negative input terminal 2 of amplifier A1. The amplifier may be of the type presently designated 2525. The positive input terminal pin 3 of the amplifier is connected to a grounded 2.2 kilo-ohm resistor 14R4, the resistor being shunted by a capacitor 14C5. Pin 4 of amplifier A1 is connected to a grounded .1 microfarad capacitor 14C4 and to the negative terminal of a 15 volt direct voltage source. Pin 7 of the amplifier is connected to a grounded .1 microfarad capacitor 14C3 and to the positive terminal of the 15 volt direct voltage source. Output terminal 6 of amplifier A1 is connected back to input terminal 2 through resistor R1 which has a value of 5 kilo-ohms, and which is shunted by a 5 picofarad capacitor 14C2. Input terminal 2 is also connected through resistor R2 to the X BUFFER lead from the output of amplifier A3, resistor R2 having a value of 10 kilo-ohms. A 5 picofarad capacitor 14C1 is shunted across resistor R2.

As described above, the output terminal of amplifier A1 is connected to the three resistors R3, R4 and R5. The 30 kilo-ohm resistor R3 is connected through resistor R6 to the positive input terminal 1 of amplifier A2. Resistor R6 has a value of 1 kilo-ohm. The 15 kilo-ohm resistor R4 is connected to a field effect transistor 14Q2 which constitutes the switch SW1, and the 3.32 kilo-ohm resistor R5 is connected to a field effect transistor 14Q1 which constitutes the switch SW2. The field effect transistors may be of the type presently designated UC155. Field effect transistor 14Q1 is under the control of the switching signal derived from the switching circuit C2S, which is introduced to the gate of transistor 14Q1 through a diode 14CR6, and field effect transistor 14Q2 is under the control of the switching signal C1S which is introduced to its gate electrode through a diode 14CR5. The gate electrodes of the field effect transistors 14Q1 and 14Q2 are connected through respective 2.2 kilo-ohm resistors 14R13 and 14R12 to the emitter of an NPN transistor 14Q3, which may be of the type designated P1S98. The emitter is also connected through a 15 kilo-ohm resistor 14R32 to the negative terminal of the 15 volt source, and the collector is connected to the positive terminal of the 15 volt source. The base of transistor 14Q3 is connected to a grounded 470 ohm resistor 14R31 and to a further 470 ohm resistor 14R30. Resistor 14R30 is connected to a 3.9 kilo-ohm resistor 14R33 and to the anode of a diode 14CR7. Resistor 14R33 is connected to the positive terminal of the 15 volt direct voltage source.

The negative input terminal 2 of amplifier A2 is connected to a grounded 499 ohm resistor 14R20 and to a further 499 ohm resistor 14R17, the latter resistor being connected to the output terminal of the amplifier. Terminal 4 of the amplifier A4 is connected to the negative 15 volt source and to a grounded .1 microfarad capacitor 14C8. Terminal 7 of amplifier A2 is connected to the positive terminal of the 15 volt source and to a grounded .1 microfarad capacitor 14C7. The output terminal 6 of amplifier A2 is connected to the resistors R20, R21, R22, R23 and R24. The output terminal is also connected to a grounded 5 kilo-ohm potentiometer 14R23, the movable contact of which is connected through a 2.49 kilo-ohm resistor 14R19 to the negative input terminal 2 of the amplifier. The output terminal 6 of the amplifier is also connected to the junction of diode 14CR7 and a 3.9 kilo-ohm resistor 14R34. The latter resistor is connected to the negative terminal of the 15 volt source. The amplifier A2 may be of the type designated AD518.

The programmed velocity circuits 199 and 201 are in the form of analog switching elements designated 14U1 and 14U2. These elements are commercially available, and are presently designated 1H5011. The switching elements 14U1 and 14U2 are under the control of a series of signals designated VELD0*, VELD1*, VELD2*, VELD3* and VELD4*. These velocity signals permit the system to be operated at different drawing rates, so as to accommodate, for example, slower cathode-ray tubes. The maximum drawing rate of a constructed embodiment is one inch per microsecond. However, the velocity controls permit five different drawing rates varying from one inch per microsecond to one inch per 500 microseconds. Any one of the five drawing rates are selectable by the operator through a proper programmed resistor selection. The velocity signals may be introduced to the analog switching elements 14U1 and 14U2 in accordance with the following truth table so as to provide for the different selected drawing rates:

| VEL0* | VEL1* | VEL2* | VELD0* | VELD1* | VELD2* | VELD3* | VELD4* | VELOCITY |
|---|---|---|---|---|---|---|---|---|
| 1 | 1 | 1 | 0 | 1 | 1 | 1 | 1 | Highest |
| 1 | 1 | 0 | 1 | 0 | 1 | 1 | 1 | next |
| 1 | 0 | 1 | 1 | 1 | 0 | 1 | 1 | next |
| 1 | 0 | 0 | 1 | 1 | 1 | 0 | 1 | next |
| 0 | 1 | 1 | 1 | 1 | 1 | 1 | 0 | Lowest |

The decoded velocity signals are used in the circuit of FIG. 8 to switch appropriate roll-off circuits and, for that purpose, the signals are applied to five analog switches contained within the analog switching elements 14U1 and 14U2 at the output of the operational amplifier A2. As previously described, the X channel gain up to this point is switchable from 1/2 to 1 during a vector draw. During the switching, as the field effect transistor 14Q1 or 14Q2 is closed, appropriate hold signals switch the output of the field effect transistors to ground forcing the output of the amplifier A3 to hold its current value. At the highest sweep speed, the switching signal VELD0* is low, and switches the filter resistor R20 to the input of the operational amplifier A3 to filter out the switching transients. The resistors R21-R24 are selected for different drawing speeds to provide the proper roll-off depending on the drawing speed requirements specified by the user.

The output of the analog switching elements 14U1 and 14U2 is connected to the negative input terminal 2 of the amplifier A3, the positive terminal 3 being grounded. The terminal 4 is connected to the negative terminal of the 15 volt source and to a grounded 0.1 microfarad capacitor 14C10. Terminal 7 is connected to the positive terminal of the 15 volt source and to a grounded 0.1 microfarad capacitor 14C9. The output terminal 6 of the amplifier is connected to the circuit of FIG. 8, and is designated "X FILTER". Terminal 8 of the amplifier A3 is connected to a 3 kilo-ohm resistor designated 14R35 which, in turn, is coupled back to the negative input terminal 2 through 15 picofarad capacitor 14C12.

Operational amplifier A3 may be of the type designated AD528. It should be noted that it utilizes a feed forward network for increased bandwidth and slewing rate.

Resistor R6 has a resistance of 1 kilo-ohm, and resistor R14 has a resistance of 5 kilo-ohms. These resistors are shunted by a 5 picofarad capacitor 14C6. The junction of resistors R6 and R14 is connected to resistor R8, which has a resistance of 5 kilo-ohms, and to a 390 kilo-ohm resistor 14R9. The latter resistor is connected to the junction of a pair of resistors 17R20 and 17R19. These latter resistors each have a resistance of 4.7 kilo-ohms, and are connected as a voltage divider across the 15 volt source.

As noted above, the total gain of the amplifiers A1, A2 and A3 varies from a minimum of 1/12, when I–F is maximum, to a maximum gain of 1, when I–F is minimum. The amplifier A1 has a gain of one-half and its output may range from zero volts (at vector end time when $I = -F$) to a maximum of $\pm$ 10 volts at the instant a full scale draw is specified ($I = +10V$ and $-F = -FV$, or $I = -10V$ and $-F = +10V$).

When any of the X, Y or Z summing signals applied to the magnitude computation network 102 (which will be described in detail in conjunction with FIG. 12) exceeds $\pm$ 3.17V, both the field effect transistors 14Q1 and 14Q2, controlled by the switching signals C1S and C2S, are open and current flow to the node of operational amplifier A2 is through the 30 kilo-ohm resistor R3, resulting in a gain of 5k/30k or one-sixth. When the largest of the three summing voltages applied to the magnitude computation network drops below 3.17 volts, the C1S field effect transistor switch 14Q2 closes to parallel the resistor R3 with the 15 kilo-ohm resistor R4. This results in a circuit gain of 5k/10k or 1/2. Finally, when the largest of the three summing voltages applied to the magnitude computation network 102 drops below 1.36 volts, the C2S field effect transistor switch 14Q1 closes and the gain becomes 5k/2.5k or 2.

The system of the invention contains three analog multiplier circuits, one each for the X, Y and Z coordinate channels. Each multiplier circuit consists of a four quadrant multiplier integrated circuit of the type presently designated MC1595D, an operational amplifier, and associated circuit components to establish the multiplier scaling factor (that is, multiplier gain GM), and the multiplier by-pass gain factor (that is, resistive gain GR). Overall gain of each multiplier circuit, under the control of the gain control input (gain control) may be varied from unit −1 to a maximum gain of −8. The multiplier circuit used in the X coordinate channel is shown in FIGS. 6 and 9, and it is to be understood that similar circuits are used in the other channels.

Figure 9:
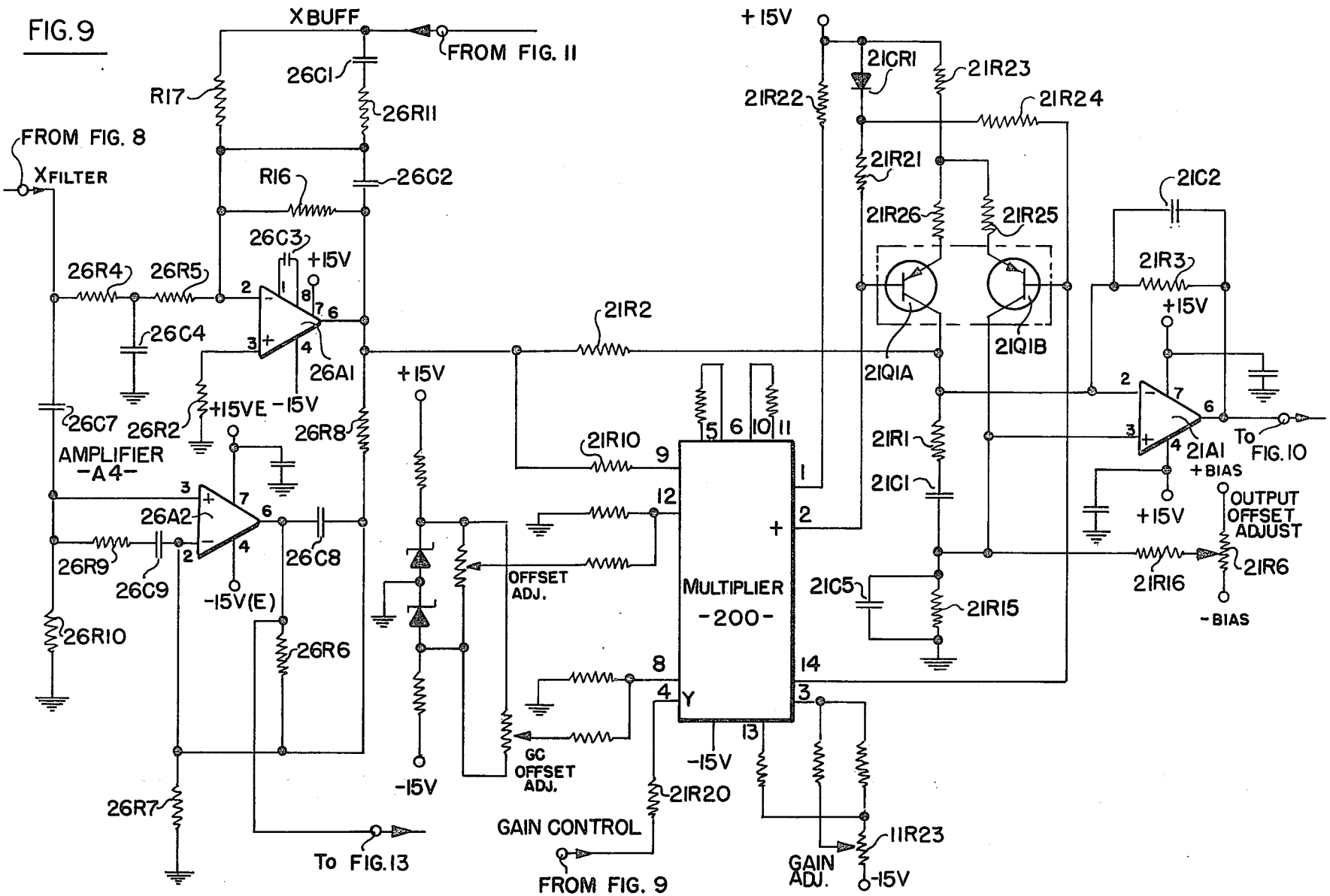

As shown in FIG. 9, the amplifier circuit A4 is actually made up to two operational amplifiers designated 26A1 and 26A2 interconnected. The output of 26A1 is filtered by the action of 26C4 while the output of 26A2 is not. The operational amplifiers 26A1 and 26A2 may be of the type presently designated CA3100.

The X filter output from the circuit of FIG. 8 is introduced to the negative input terminal of operational amplifier 26A1 through a pair of 1 kilo-ohm resistors 26R4 and 26R5. The junction of the resistors is connected to a grounded 150 picofarad capacitor 26C4. Terminal 7 of operational amplifier 26A1 is connected to the positive 15 volt source, and terminal 4 is connected to the negative 15 volt source. A 5 picofarad capacitor 26C3 intercouples terminals 1 and 8 of the operational amplifier, and positive input terminal 3 is connected to an 820 ohm grounded resistor 26R2. Output terminal 6 is connected back to the input terminal 2 of the operational amplifier through resistor R16 which may have a resistance of 6 kilo-ohms, and negative input terminal 2 is connected to the X OUTPUT lead through resistor R17, which may have a resistance of 2 kilo-ohms. A 2 picofarad capacitor 26C2 is shunted across resistor R16, and is connected to a 3.9 kilo-ohm resistor 26R11. The resistor is connected to a 15 picofarad capacitor 26C1 which, in turn, is connected to the X OUTPUT lead.

Figure 13:
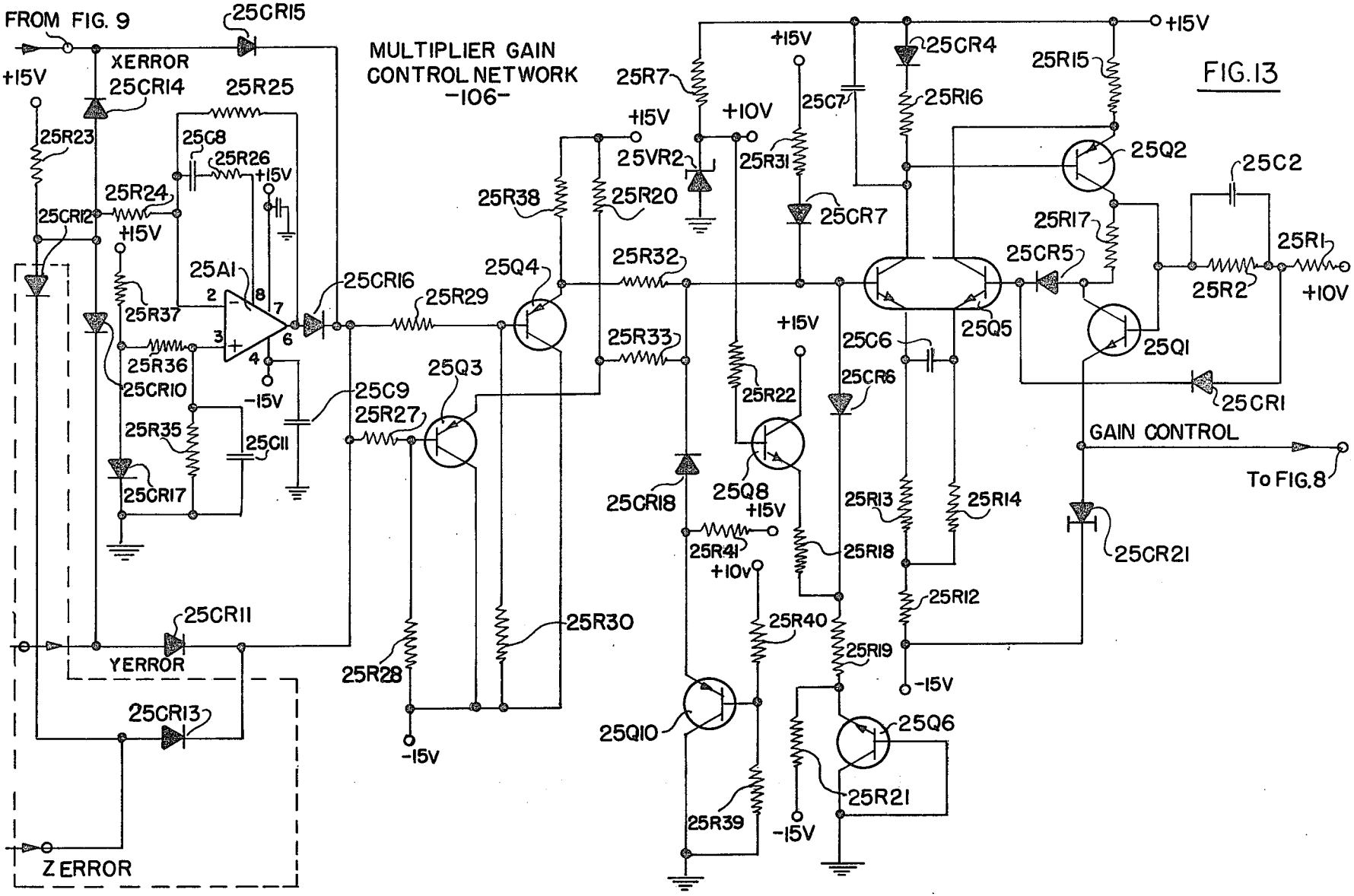

The output terminal 6 of operational amplifier 26A1 is connected to the X INPUT terminal 9 of an integrated circuit multiplier 200 through a 1 kilo-ohm resistor 21R10. A gain control for the multiplier, derived from the multiplier gain control network 106 of FIG. 13 is introduced through a 1 kilo-ohm resistor 21R20 to the Y INPUT terminal 4 of the multiplier.

Terminal 1 of the multiplier is connected through a 2.49 kilo-ohm resistor 21R22 to the positive 15 volt source. Positive output terminal 2 is connected to the base of a PNP transistor 21Q1A, and the negative output terminal 14 is connected to the base of a PNP transistor 21Q1B.

The transistors 21Q1A and 21Q1B may be of the type presently designated 2N3809. The base of transistor 21Q1A is connected through a 2.49 kilo-ohm resistor 21R21 to the cathode of a diode 21CR1 and to a 2.49 kilo-ohm resistor 21R24. The anode of diode 21CR1 is connected to the positive 15 volt source. The emitter of the transistor is connected to a 1 kilo-ohm resistor 21R26 which, in turn, is connected to a 1-kilo-ohm resistor 21R23 to the positive 15 volt source, and which is also connected through a 1 kilo-ohm resistor 21R25 to the emitter of transistor 21Q1B. The resistor 21R24 is connected to the base of transistor 21Q1B. The collector of transistor 21Q1A is connected to a resistor 21R1 of 390 ohms which, in turn, is connected to an 18 picofarad capacitor 21C1. The collector of the transistor is also connected back to the output of operational amplifier 26A1 through a 2.21 kilo-ohm resistor 21R2.

Capacitor 21C1 is connected to a grounded 1.82 kilo-ohm resistor 1R15 which is shunted by a 2 picofarad capacitor 21C5. The collector of transistor 21Q1B is also connected to resistor 21R15. The collector of transistor 21Q1B is also connected through a 178 kilo-ohm resistor 21R16 to the movable contact of a 50 kilo-ohm potentiometer 21R6. The potentiometer is connected across a source of bias potential, and it serves as an output off-set adjustment.

The collectors of the transistors 21A1A and 21Q1B are connected respectively to the negative and positive input terminals of an operational amplifier 21A1, which may be of the type presently designated CA3100. The terminal 7 of amplifier 21A is connected to the positive 15 volt source, and terminal 4 is connected to the negative 15 volt source. The output terminal 6 of the operational amplifier is connected to a programmed velocity circuit 201 in FIG. 10, and is connected back to the negative input terminal 2 through a 10 kilo-ohm resistor 21R3, the resistor being shunted by a 7 picofarad capacitor 21C2. The output also is connected to a deflecting velocity magnitude computation network 205 (FIG. 6).

The total gain of the multiplier integrated circuit is established by the equation:

$$GT = GR + GM$$

where:

GT – total circuit gain

GR – resistive gain external to the multiplier

GM – multiplier gain.

The multiplier gain GM = (GC(k where:

GC – gain control voltage applied to multiplier $k$ – scale factor of multiplier.

The resistive gain (GR) is set at 4.5 by the resistance ratio of resistors 21R3/21R2 - 10k/2.21k or 4.5. The voltage input to the multiplier circuit of FIG. 8 is applied to the inverting input terminal of operational amplifier 26A1 which thereby provides a by-pass gain of −4.5. The multiplier output is then added to or subtracted from that value. The multiplier resistances have been selected to provide an overall gain for the multiplier 200 which varies from +3.5 (GC input = +4V) to −3.5 (GC input = −4V). Total gain of the multiplier circuit of FIG. 8 then becomes:

$$\begin{aligned} GT &= GR + Gm \\ &= -4.5 + 3.5 = \text{gain of } -1 \text{ when } GC = +AV \\ &= -4.5 + 0.0 = \text{gain of } -4.5 \text{ when } GC = OV \\ &= -4.5 + (-3.5 = \text{gain of } -8 \text{ when } GC = +4V. \end{aligned}$$

Since the maximum gain of 3.5 for the multiplier 200 is desired when $GC = 4V$, a scale factor ($k$) of 0.875 is established as follows:

$$Eout = (Ein)\,(GC)k$$

$$\frac{Eout}{Ein} = 3.5 = (4)k$$

$$k = \frac{3.5}{4} = .875$$

The required $k$ (0.875) is then achieved by resistor selection and required current flow $I_3$ into pin 3 of the multiplier 200 as follows:

$$k = \frac{2RL}{I_3(RX)(RY)} = .875 = \frac{20K}{I_3(6.65K)(6.65K)} \times \frac{2.49K}{1K}$$

$$I_3 = \frac{(20K)(2.49K)}{.875(6.65K)(6.65K)} = 1.287\ mA$$

Current into pin 3 of the multiplier is then adjusted by potentiometer 11R23 to a value of approximately 1.287 mA by the scale factor potentiometer 11R23 to establish a multiplier gain of 3.5 when the GC input is 4V. Current into pin 13 ($I_{13}$) is set by the 11.5K resistor to be approximately equal to 1.2 mA.

The operational amplifier 25A2 provides the X error signal for the multiplier gain control network 106, which will be described in detail in conjunction with FIG. 13. The X filter input from FIG. 8 is introduced through a 39 picofarad capacitor 26C7 to the positive input terminal 3 of operational amplifier 26A2. The capacitor is also connected to the junction of a 680 ohm resistor 26R9 and grounded 2 kilo-ohm resistor 26R10. Resistor 26R9 is coupled through a 150 picofarad capacitor 26C9 to the negative terminal of negative input terminal 2 of the operational amplifier. The negative terminal is also connected to a grounded 6.04 kilo-ohm resistor 26R7. The output terminal 6 is connected to a 6.04 kilo-ohm resistor 26R6 which, in turn, is connected to the grounded resistor 26R7. The output terminal 6 is also connected to the multiplier gain control network 106 of FIG. 13, and supplies the X error signal to the gain control network. The output terminal is further connected to a 2 picofarad capacitor 26C6 which connects through a 6.04 kilo-ohm resistor 26R8 to output terminal 6 of amplifier 26A1, and which also connects to the junction of resistor 26R6 and 26R7.

Figure 10:
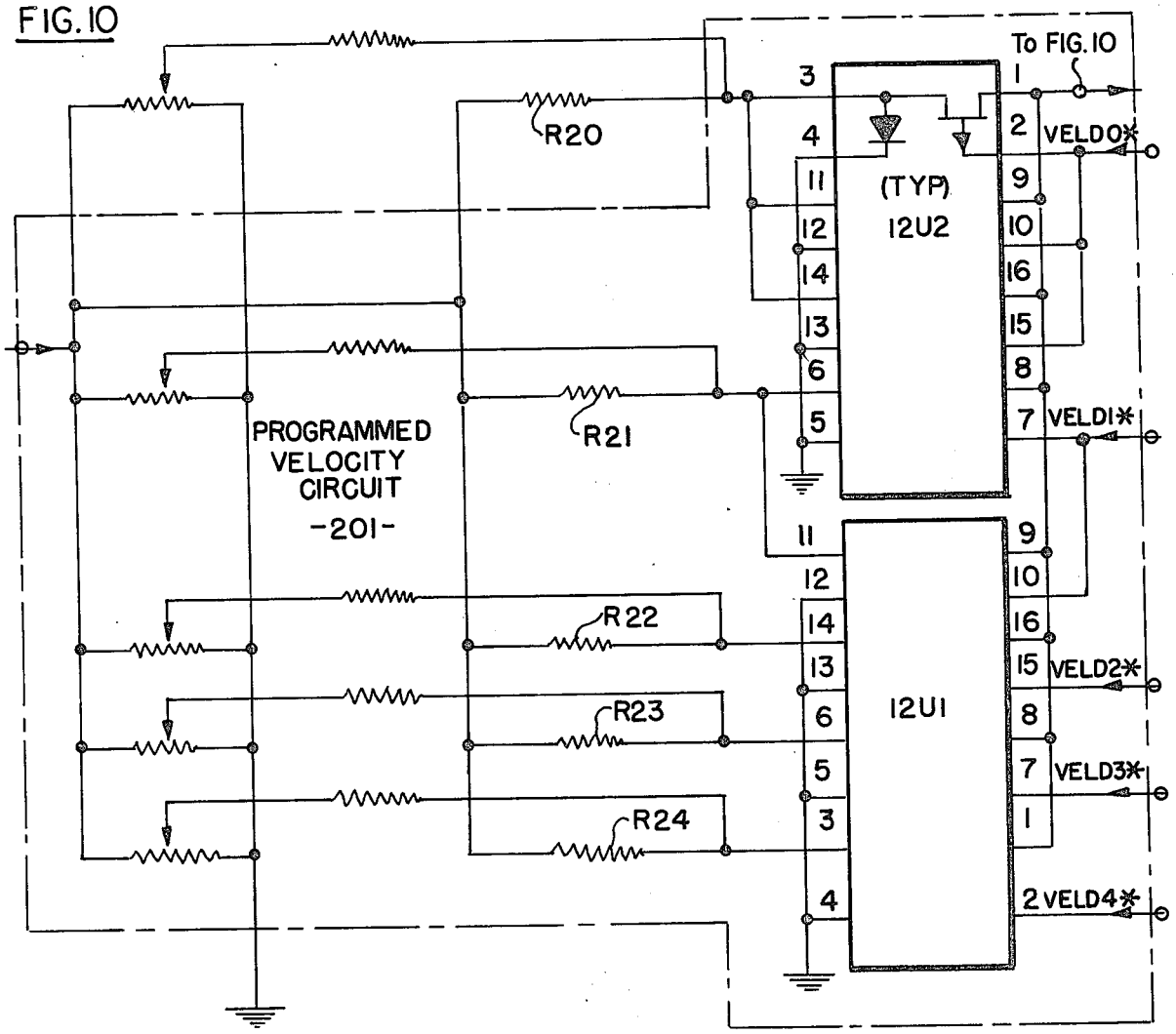

The output of operational amplifier 21A1 of FIG. 8 is applied to the resistors R20, R11, R22, R23 and R24 in the programmed velocity circuit 201 of FIG. 10. The programmed velocity circuit 201 includes two integrated circuit analog switching devices designated 12U1 and 12U2, each of which may be of the type designated IH5011. These switches, like the equivalent switches in FIG. 8 are under the control of the velocity signals VELD0*, VELD1*, VELD2*, VELD3*, and VELD4*, as described above.

Figure 11:
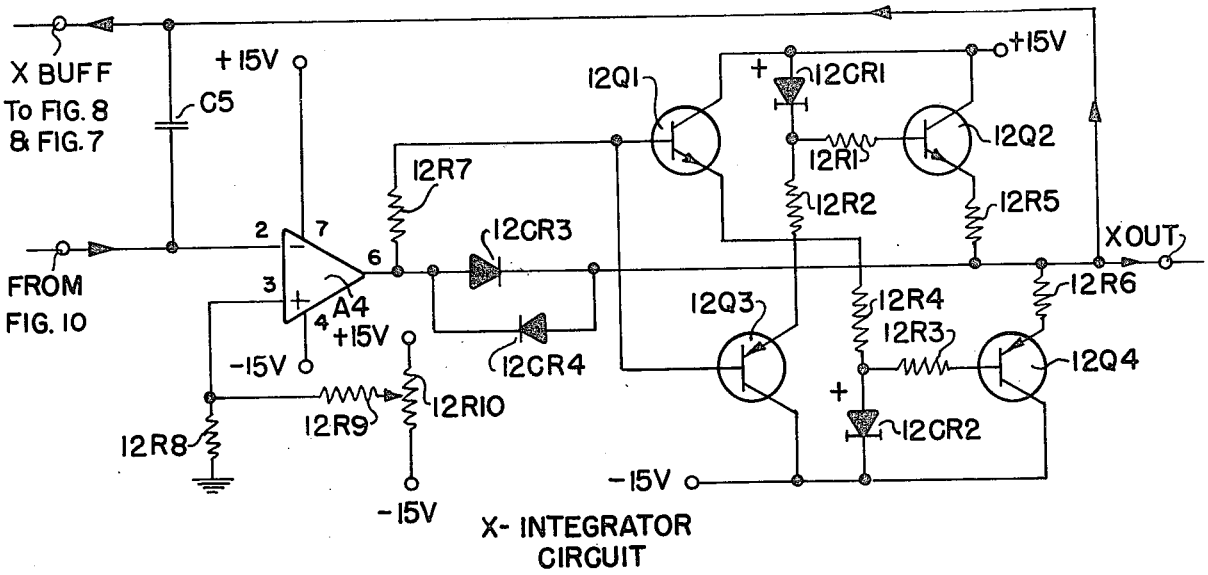

The programmed velocity circuit 201 is used to control the resistance-capacitance time factor of the integrator circuit A5 of FIG. 11. At the highest drawing speed, for example, one inch per microsecond, the 2 kilo-ohm resistor 20 is switched into the integrating circuit by VELD0* being low. The four remaining resistors R21, R22, R23 and R24 are selected to satisfy user drawing speed requirements. The integrator resistance/capacitance time increases with increased values of resistance which, in turn, decreases the current available to the integrator circuit and results in longer integrator slope with corresponding decreases cathode-ray tube sweep speed.

The X integrator circuit of FIG. 11 includes the operational amplifier A4, and the output from the programmed velocity circuit 201 of FIG. 10 is introduced to the negative input terminal 2 of the amplifier. The positive input terminal 3 is connected to a 470 ohm grounded resistor 12R8 and to a 220 kilo-ohm resistor 12R9. Resistor 12R9 is connected to the moving contact of a 50 kilo-ohm potentiometer 12R10, the potentiometer being connected across the positive and negative 15 volt power supplies.

The output terminal 6 of operational amplifier A4 is connected through a 100 ohm resistor 12R7 to the base of an NPN transistor 12Q1 and to the base of a PNP transistor 12Q3. Transistor 12Q1 may be of the type designated TIS98, and transistor 12Q3 may be of the type designated TIS93.

The emitter of transistor 12Q1 is connected through a 10 ohm resistor 12R4 to a 100 ohm resistor 12R3 and to the anode of a constant current diode 12CR2. The cathode of diode 12CR2 is connected to the negative 15 volt source, as is the collector of transistor 12Q3. Resistor 12R3 is connected to the base of a PNP transistor 12Q4.

The emitter of transistor 12Q3 is connected through a 10 ohm resistor 12R2 to the junction of a 100 ohm resistor 12R1 and the cathode of a constant current diode 12CR1. The anode of diode 12CR1 is connected to the positive 15 volt source, and resistor 12R1 is connected to the base of an NPN transistor 12Q2. Transistor 12Q2 may be of the type designated TIS98 and transistor 12Q4 may be of the type designated TIS93.

The output terminal 6 of operational amplifier A4 is connected through a diode 12CR3 to the junction of a pair of 15 ohm resistors 12R5 and 12R6, the junction being connected to the "X OUT" terminal. The "X OUTPUT" lead is connected to capacitor C5, which in turn, is connected to the negative input terminal 2 of operational amplifier A4. Resistor 12R5 is connected to the emitter of transistor 12Q2, and resistor 12R6 is connected to the emitter of transistor 12Q4. The collector of transistor 12Q2 is connected to the positive 15 volt source, and the collector of transistor 12Q4 is connected to the negative 15 volt source. The diode 12CR3 is shunted by a diode 12CR4 in a back-to-back relationship.

The X and Y channels use identical integrator circuits, such as the circuit A5 shown in FIG. 11 for the X channel, and each of the integrators receive its input from the corresponding multiplier 200 of FIG. 8 by way of the programmed velocity switching circuit 201 of FIG. 10. The X integrator output is buffered by the circuit of transistors 12Q1, 12Q2, 12Q3 and 12Q4, before being transmitted to the deflection circuit of the cathode-ray tube.

When a new step function end point coordinate signal is introduced to the X INPUT terminal of FIG. 6, the integrator circuit of FIG. 10 is driven until its outputs (X OUT and X BUFFER) are equal in amplitude and opposite in polarity from the −F input applied to operational amplifier A1 of FIG. 6. At that time, the output from multiplier 200 is zero, and the charge across the holding capacitor C5 is equal to X OUTPUT. If the integrator output is zero volts, buffer transistors 12Q2 and 12Q4 are equally conductive and X OUTPUT is zero.

When the integrator output increases in the positive direction, the forward bias on the PNP transistors 12Q3 and 12Q4 decreases while the forward bias on the NPN transistors 12Q1 and 12Q4 increases. As a result, the voltage at the emitters of the transistors 12Q2 and 12Q4 rises which, in turn, raises X OUT. The constant current diodes 12CR1 and 12CR2 provide a constant current source for the base bias of transistors 12Q2 and 12Q4. The total voltage gain of the buffer circuitry is unity. The integrator outputs are limited to ± 10 volts which is the limit of X INPUT. When X OUT is positive, the X deflection on the cathode-ray tube is in the plus X direction. Conversely, when X OUT is negative, the X deflection on the cathode-ray tube is in the negative direction, with the cathode-ray beam normally centered on the viewing screen.

Figure 12:
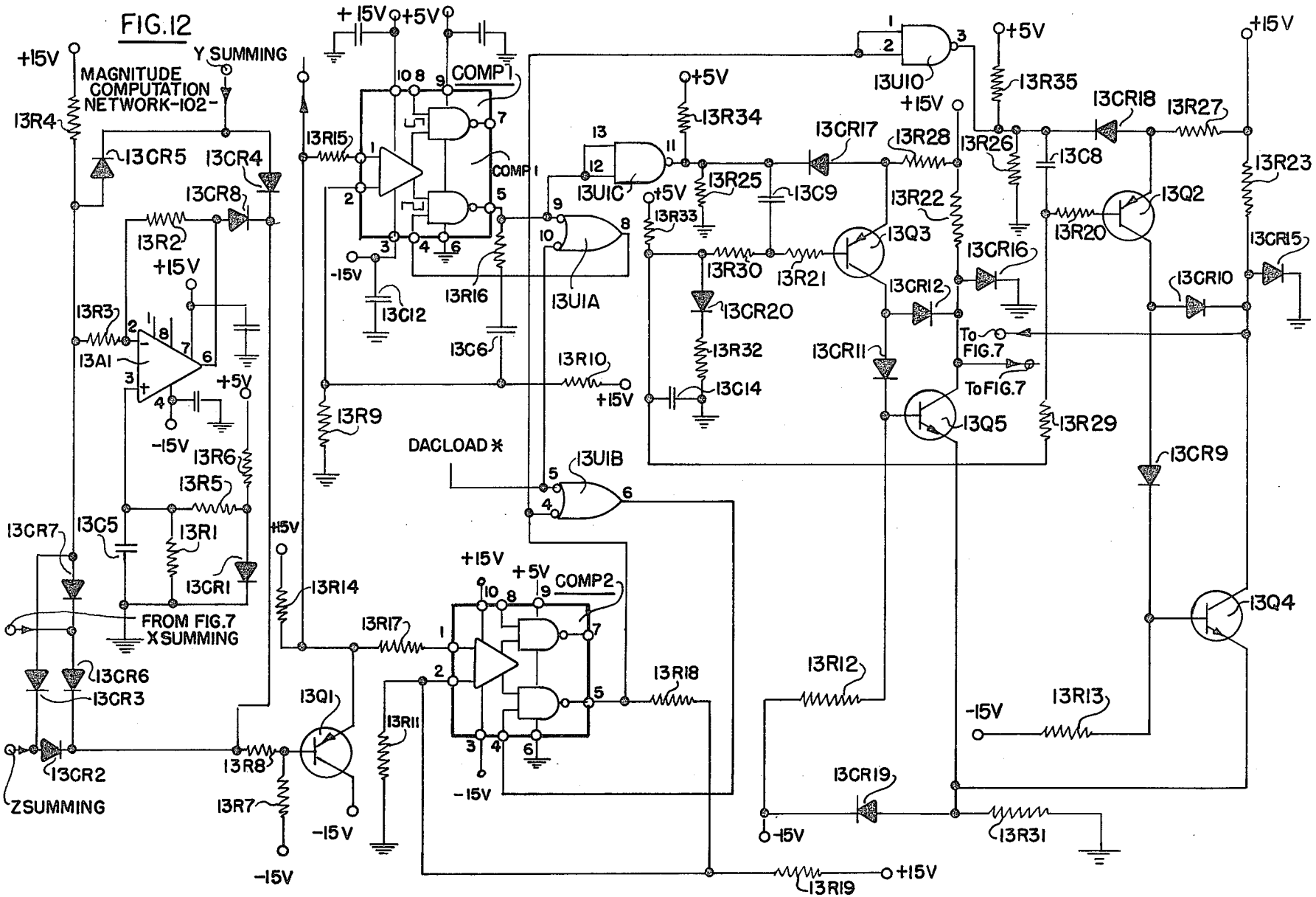

The gain switching control circuit of FIG. 6 is shown in more detail in FIG. 12. The X summing signal from the circuit of FIG. 8 is introduced to the junction of a pair of diodes 12CR7 and 12CR6, the anode of diode 12CR7 being connected to the positive 15 volt source through an 18 kilo-ohm resistor 12R4. The Y summing signal derived from a similar circuit in the Y coordinate channel is introduced to the junction of a pair of diodes 12CR5 and 12CR4, the anode of diode 12CR5 being connected to the resistor 12R4. Likewise, the Z summing signal derived from a similar circuit in the Z coordinate channel is introduced to the junction of a pair of diodes 13CR2 and 13CR3. The anode of diode 13CR3 is connected to resistor 13R4, and the cathode of diode 13CR6, together with the cathode of diodes 13CR2 and 13CR4 are connected through a 220 ohm resistor 13R8 to the base electrode of a PNP transistor 13Q1 of the type designated TIS93. The base of transistor 13Q1 is connected through an 18 kilo-ohm resistor 13R7 to the negative terminal of the 15 volt source, and the collector of the transistor is directly connected to the negative terminal of the source.

The junction of the diodes 13CR5, 13CR3 and 13CR7 with the resistor 13R4 is connected through a 4.99 kilo-ohm resistor 13R3 to the negative input terminal 2 of an operational amplifier 13A1 which is connected to constitute the magnitude computation network 102. The positive input terminal 3 of the amplifier is connected to a 1000 picofarad grounded capacitor 13C5, to a 4.7 kilo-ohm grounded resistor 13R1 and to a 4.7 kilo-ohm resistor 13R5. Resistor 13R5 is connected to the anode of a diode 13CR1 and to an 18 kilo-ohm resistor 13R6. The cathode of the diode is grounded, and resistor 13R6 is connected to the positive terminal of the 5 volt source. The output terminal 6 of the operational amplifier 13A1 is connected to the negative input terminal 2 through a 4.99 kilo-ohm resistor 13R2, and is also connected to the anode of a diode 13CR8. The cathode of diode 13CR8 is connected to the resistor 13R8. The collector of transistor 13Q1 is connected to the negative terminal of the 15 volt source, and the emitter is connected to the junction of a 470 ohm resistor 13R1, a 4.7 kilo-ohm resistor 13R14, and a 470 ohm resistor 13R15.

The resistor 13R14 is connected to the positive terminal of the 15 volt source, the resistor 13R15 is connected to terminal 1 of an integrated circuit constituting the comparator COMP1, the integrated circuit being of the type designated LM361. The resistor 13R17 is connected to the input terminal 1 of a similar integrated circuit constituting the comparator COMP2. Terminal 2 of comparator COMP1 is connected to a 1 kilo-ohm grounded resistor 13R9, and through a 3.74 kilo-ohm resistor 13R10 to the positive 15 volt source. Terminal 2 of comparator COMP2 is connected to a 499 ohm grounded resistor 13R11, and through a 4.99 kilo-ohm resistor 13R19 to the positive 15 volt source. Output terminal 5 of comparator COMP1 is connected to an input terminal of "and" gate 13U1A, and to a 1.8 kilo-ohm resistor 13$16. Resistor 13R16 is connected to a 150 picofarad capacitor 13C6 which, in turn, is connected to the junction of resistors 13R9 and 13R10. Output terminal 5 of the comparator COMP2 is connected to an input terminal of an "and" gate 13U1B and to a 4.7 kilo-ohm resistor 13R18. Resistor 13R18 is connected to a 100 picofarad capacitor 13C7 which, in turn, is connected to the junction of resistors 13R11 and 13R19. A command signal DACLOAD* is introduced to the "and" gates 13U1A and 13U1B. The output terminal of "and" gate 13U1A is connected back to terminal 4 of the comparator COMP1, and the output terminal of "and" gate 13U1B is connected back to the terminal 4 of the comparator COMP2.

Output terminal 5 of comparator COMP1 is also connected through an inverter 13U1C, and through a diode 13CR17 to the emitter of a PNP transistor 13Q3, of the type designated TIS93. The output terminal 5 of the comparator COMP2, on the other hand, is introduced through an inverter 13UID, and through a diode 13CR18 to the emitter of a PNP transistor 13Q2, which also may be of the type designated TIS93.

The output terminal of inverter 13U1C is connected to the junction of a 2.2 kilo-ohm resistor 13R34 and a grounded 3.9 kilo-ohm resistor 13R25. The output terminal is also connected to a 27 picofarad capacitor 13C9. Resistor 13R34 is connected to the positive terminal of the 5 volt source. Capacitor 13C9 is connected to the junction of a 220 ohm resistor 13R21 and a 470 ohm resistor 13R30. Resistor 13R21 is connected to the base of transistor 13Q3. Resistor 13R30 is connected through a 1 kilo-ohm resistor 13R33 to the positive terminal of the 5 volt source, and is also connected to a grounded 0.1 microfarad capacitor 13C14 and to the anode of a diode 13CR20. The cathode of diode 13CR20 is connected to a grounded 220 ohm resistor 13R32.

The emitter of transistor 13Q3 is connected through a 1.5 kilo-ohm resistor 13R28 to the positive terminal of the 15 volt source and to a 6.8 kilo-ohm resistor 13R22. The latter resistor is connected to the anode of a diode 13CR16, to the cathode of a diode 13CR12 and to the collector of an NPN transistor 13Q5. The transistor 13Q5 may be of the type designated TIS98.

The cathode of diode 13CR16 is grounded, and the anode of diode 13CR12 is connected to the collector of transistor 13Q3 and to the anode of a diode 13CR11. The cathode of the latter diode is connected to the base of transistor 13Q5 and to a 330 ohm resistor 13R12. The resistor is connected to the negative terminal of the 15 volt source, as is the cathode of a diode 13CR19. The anode of diode 13CR19 is connected to the emitter of transistor 13Q5 and to a 2.2 kilo-ohm grounded resistor 13R31. The collector of transistor 13Q5 supplies the C1S switching signal to the circuit of FIG. 8.

The output terminal 3 of inverter 13U1D is also connected to a 2.2 kilo-ohm resistor 13R35 and to a grounded 3.9 kilo-ohm resistor 13R26, and to a 27 picofarad capacitor 13C8. Resistor 13R35 is connected to the positive terminal of the 5 volt source, and capacitor 13C8 is connected to a 220 ohm resistor 13R20, and through a 470 ohm resistor 13R29 back to the junction of resistors 13R33 and 13R30.

Resistor 13R20 is connected to the base of transistor 13Q2, the collector of which is connected to the anode of a diode 13CR10 and to the anode of a diode 13CR9. The cathode of diode 13CR10 is connected to the base of an NPN transistor 13Q4 which may be of the type designated TIS98. The base of the transistor is also connected through a 330 ohm resistor 13R13 to the negative terminal of the 15 volt source, and the emitter of the transistor is connected back to the emitter of transistor 13Q5.

The collector of transistor 13Q4 is also connected to the anode of a diode 13CR15 and to a 6.8 kilo-ohm resistor 13R23. The cathode of diode 13CR15 is grounded, and resistor 13R23 is connected to the positive terminal of the 15 volt source and to a 1.5 kilo-ohm resistor 13R27. The resistor is connected to the emitter of transistor 13Q2. The collector of transistor 13Q4 supplies the C2S switching signal to the circuit of FIG. 8.

The X, Y and Z summing signals are applied to the unity gain operational amplifier 13A1 in FIG. 12. The output of the amplifier will always be a positive voltage equal in amplitude to the largest input voltage regardless of whether the input is positive or negative. For example, if the X SUMMING signal is +3 volts while the Y and Z signals are ±1 volt, diode 13CR6 is forward biased and the +3 volts is applied to the base of the emitter follower transistor 13Q1. The emitter voltage of +3 volts is then applied to the No. 1 inputs of the comparators COMP1 and COMP2. If the X signal is −3 volts, on the other hand, while the Y and Z signals are still ±1 volt, diode 13CR6 is back biased. However, diode 13CR7 is now forward biased and applies the −3 volt to the inverting input of the amplifier 13A1 which again places +3 volts at the base of transistor 13Q1.

At the end of a vector draw, both comparator outputs CMP1 and CMP2, and their strobes at the respective lines 4 are low to hold the comparators disabled. When a DACLOAD pulse is generated to indicate the beginning of a new vector draw, DACLOAD* is low and raises the strobes to enable switching of the comparators COMP1 and COMP2. If the comparator inputs are greater than +3.17 volts, the comparator outputs go low to retain the enabling strobes after "DACLOAD"* goes high. Comparator COMP1 has its input voltage at input terminal 2 referenced to 3.17 volts, while the second input of comparator COMP2 at its input terminal 2 is referenced to +1.36 volts.

During the draw, as the integrators are driving, the summing signals start moving towards zero volts. When the input to comparator COMP1 drops below 3.17 volts, the comparator switches and its output goes high to drop it strobe and disable the comparator COMP1 for the balance of the draw. As the draw is nearing completion, when the largest of the summing signals is less than ±1.36 volts, comparator COMP2 switches and its output goes high to drop its strobe and to disable the comparator COMP2 for the balance of the draw. The high CMP1 and CMP2 signals at the output terminals 5 of the two comparators are used to generate the switching signals C1S and C2S through the circuits of transistors 13Q3, 13Q5, 13Q2 and 13Q4 for switching the field effect transistors 14Q1 and 14Q2 in the circuit of FIG. 8.

The C1S and C2S signals are generated during the draw to provide increased gain in the X, Y and Z analog channels. If any of the summing signals are greater than ±3.17 volts at the start of the draw, CmP1, CMP2, C1S and C2S are all low. At this time, transistors 13Q2-13Q5 in FIG. 11 are all conductive, and both the signals C1S and C2S are established at approximately −14 volts. When the comparator COMP1 switches, CMP1 goes high, is inverted by 13U1C, and the emitter of transistor 13Q3 goes low to render the transistor non-conductive. At the same time, the collector of transistor 13Q3 goes low, and its value is applied to the base of transistor 13Q5 to render the latter transistor non-conductive. The collector of transistor 13Q5 (C1S) then rises to +4.3 volts and renders the field effect transistor 14Q2 of FIG. 8 conductive to increase the total amplifier gain 300% from one-twelfth to one-fourth.

The switching signal C2S, which is controlled by the signal CMP2, is generated in the same manner to control the field effect transistor 14Q1 in FIG. 8. The field effect transistors 14Q1 and 14Q2 in FIG. 8 are controlled by the switching signals C1S and C2S applied to their gates, as described above, together with a gate control circuit comprised of transistor 14Q3 in FIG. 8 and its associated circuitry. The purpose of the circuit of transistor 13Q3 is to hold the gates and sources of the field effect transistors 14Q1 and 14Q2 at the same potential when the field effect transistors are switched on, thereby eliminating the possibility of signal distortion which could result if gate-to-source current were permitted to flow. When the field effect transistor 14Q2 is switched on, the field effect source signal is amplified by amplifier A2 in FIG. 8 which has a gain of 2, and is then applied to the base of the emitter follower 14Q3, which has a gain of .5 due to resistors 14R30 and 14R31. The emitter of transistor 14Q3 therefore is equal in amplitude and polarity to the source of each of the field effect transistors 14Q1 and 14Q2, and the potential of the emitter is applied to the gates of the field effect transistors to assure that no gate current will flow.

The multiplier gain control network 106 of FIG. 6 is shown in more detail in FIG. 13. The multiplier gain control network 106, as shown in FIG. 13, receives X, Y and Z error signals. For example, it receives the X error signal from amplifier 26A2 in FIG. 19, and it receives the Y and Z error signals from similar circuitry in the Y and Z channels. The X error signal is introduced to the junction of a pair of diodes 25CR15 and 25CR14. The Y error signal is introduced to the junction of a pair of diodes 25CR10 and 25CR11, and the Z error signal is introduced to the junction of a pair of diodes 25CR12 and 25CR13. The cathodes of diodes 25CR11, 25CR13 and 25CR15 are all connected to the junction of a diode 25CR16 and a 220 ohm resistor 25R29. The anodes of diodes 25CR10, 25CR12 and 25CR14 are connected to the junction of a 33 kilo-ohm resistor 25R23 and a 4.99 kilo-ohm resistor 25R24. The resistor 25R23 is connected to the positive 15 volt source, and the resistor 25R24 is connected to the negative input terminal 2 of operational amplifier 25A1.

The positive input terminal 3 of amplifier 25A1 is connected to the junction of a 4.7 kilo-ohm resistor 25R36 and of a 4.7 kilo-ohm grounded resistor 25R35. Resistor 25R35 is shunted by an 82 picofarad capacitor 25C11. Resistor 25R16 is connected to the junction of a 33 kilo-ohm resistor 25R37 and the anode of a diode 25CR17. Resistor 25R37 is connected to the positive of the 15 volt source, and the cathode of diode 25CR17 is grounded. Terminal 8 of the amplifier 25A1 is connected back to input terminal 2 through a 3 kilo-ohm resistor 25R26 and through a 15 picofarad capacitor 25C8. The output terminal 6 of the amplifier 25A1 is connected to the anode of diode 25CR16, and is also connected back to the input terminal 2 through a 4.99 kilo-ohm resistor 25R25.

Resistor 25R29 is connected to the base of a PNP transistor 25Q4, and the junction of the resistor and diode 25CR16 is connected through a 220 ohm resistor 25R27 to the base of a PNP transistor 25Q3. Both transistors may be of the type designated T1S93. The collectors of transistors 25Q3 and 25Q4 are both connected to the negative 15 volt source. The base of transistor 25Q3 is connected through a 22 kilo-ohm resistor 25R28, and the base of transistor 25Q4 is connected through a 22 kilo-ohm resistor 25R30 to that terminal. The emitter of transistor 25Q4 is connected through a 3.9 kilo-ohm resistor 25R38 to the positive 15 volt source, and the emitter of transistor 25Q3 is connected through a 3.9 kilo-ohm resistor 25R20 to that terminal.

The emitter of transistor 25Q4 is further connected through a 2 kilo-ohm resistor 25R32 to the first base of a double transistor 25Q5, of the NPN type, which may be of the type designated 2N6090. The base is also connected to the anode of a diode 25CR6 and to the cathode of a diode 25CR18, and to the emitter of transistor 25Q3 through a 2 kilo-ohm resistor 25R33. The base is also connected through a diode 25CR7 and through a 10 kilo-ohm resistor 25R31 to the positive terminal of the 15 volt source.

The cathode of diode 25CR6 is connected to the junction of a 1.87 kilo-ohm resistor 25R18 and an 845 ohm resistor 25R19. Resistor 25R18 is connected to the emitter of an NPN transistor 25Q8 which may be of the type designated T1598. The collector of the transistor is directly connected to the positive 15 volt source, and the base is connected to a 220 ohm resistor 25R22 to the positive 10 volt source, the 10 volt source also being connected to the cathode of a Zener diode 25CR2, whose anode is grounded. The Zener diode may be of the type designated 758A. The cathode of the diode is connected through a 470 ohm resistor 25R7 to the positive 15 volt source.

The anode of diode 25CR18 is connected to a 4.7 kilo-ohm resistor 25R41 and to the emitter of a PNP transistor 25Q10. Transistor 25Q10 may be of the type designated T1593. The collector of the transistor is grounded and the base is connected to the junction of a 10 kilo-ohm resistor 25R40 and a grounded 330 ohm resistor 25R39. Resistor 25R40 is connected to the positive 10 volt source.

The resistor 25R19 is connected to the emitter of an NPN transistor 25Q6, which may be of the type designated T1598. The collector of the transistor is grounded, as is the base. The emitter is connected through a 1.8 kilo-ohm resistor 25R21 to the negative 15 volt source. The first emitter of the transistor 25Q5 is connected to the junction of a 150 pico-farad capacitor 25C6 and 47 ohm resistor 25R13. The emitter of the second section of transistor 25Q5 is connected to the capacitor and to a 47 ohm resistor 25R14. Both resistors are connected through a common 3.9 kilo-ohm resistor 25R12 to the negative 15 volt source.

The first collector of transistor 25Q5 is connected through a 2.2 kilo-ohm resistor 25R16 and through a diode 25CR4 to the positive of the 15 volt source, the aforesaid elements being shunted by a 10 picofarad capacitor 25C7. The first collector is also connected to the base of a PNP transistor 25Q2, which may be of the type designated T1S93. The emitter of the transistor is directly connected to the second collector of transistor 25Q5 and through a 680 ohm resistor 25R15 to the positive 15 volt source. The collector of transistor 25Q2 is connected through a 100 ohm resistor 25R17 to the collector of an NPN transistor 25Q1, the latter transistor being of the type designated 2N4275. The collector of transistor 25Q1 is connected through a diode 25CR5 to the second base of the transistor 25Q5, and through a diode 25CR1 to the junction of a 1.78 kilo-ohm resistor 25R2 and a 15 kilo-ohm resistor 25R1. Resistor 25R2 is shunted by a 15 picofarad capacitor 25C2, and resistor 25R1 is connected to the positive 10 volt source. The junction of resistor 25R2 and capacitor 25C2 is connected to the collector of transistor 25Q2 and to the base of transistor 25Q1. The emitter of transistor 25Q1 is connected through a diode 25CR21 to the negative 15 volt source. The latter diode may be of the type designated CL4720. The emitter of the transistor 25Q1 is also connected to the the gain control output terminal which supplies the gain control voltage to the multiplier 200 of FIG. 9.

The circuit of FIG. 13 operates in known manner as a gain control circuit, and it responds to the X, Y and Z error signals, in the same manner as the magnitude computation network 102 of FIG. 12, to apply appropriate gain control voltages to the multipliers in the X, Y and Z channels, such as the multiplier 200. The gain control serves to hold the multiplier outputs at ±5 volts during a draw to insure linear integration of the deflection signals.

Specifically, the multiplier gain control circuit of FIG. 13 receives the error signals from the summation amplifiers, and through the use of voltage magnitude computation provided by the circuitry of amplifier 25A1, provides a positive voltage output equal to amplitude to the largest error signal, regardless of its polarity. This signal is applied to the subsequent circuitry in the gain control circuit which acts as a wave shaper and which generates the GAIN CONTROL signal for the multipliers. The error signals decrease in amplitude as the integrator outputs approach the input voltage, thereby driving the gain control signal in the negative direction and increasing the multiplier gains. The integrator circuit of the amplifier A5 receives the multiplier output and is driven until its buffered output is equal in amplitude and opposite in polarity to the X INPUT signal.

Referring again to FIG. 6, the X INPUT signal applied to the amplifier A1 flows through the amplifiers and multiplier to the X integrator circuit of the amplifier A5 to provide a final X deflection voltage for the cathode-ray tube. A similar circuit is incorporated into the Y channel. The integrator output is also fed back to the nodes of the three operational aplifiers A1, A2 and A4 to provide a closed loop configuration for integrator time constant control. The circuit is mechanized to generate a constant ± 5 volt multiplier output during the draw by varying the amplifier gain and the multiplier gain factor. This provides a constant current source for the integrator with a resulting linear integration until near the end of the vector draw. At that time the output of multiplier 200 drops towards zero while the vector velocity of the cathode-ray beam describes to zero on a time constant curve.

Operation of the entire circuit is such that when a step signal (−F) is applied to the X input specifying a new end point, the integrator drives until its output voltage I (X OUT) equals −F. At that time the output of the operational amplifier A1 is zero, the output of operational amplifier A3 = −I, the input and output of summing amplifier A4 is zero, and the output of multiplier 200 to the integrator is zero. The circuit gains at this time are maximum (total amplifier gain = 3 and multiplier gain = −8). The integrator then retains its output voltage, respective of the beam position at the end of the draw, until X INPUT is again changed by a new step voltage indicating a new end point.

It should be noted that since the integrator is not switched out of the circuit between vector draws, the integrator drift and consequent deflection voltage drift is prevented, even though the system is not in use.

Amplifier A4 has a gain of $-6K/2k$ or $-3$ for the A3 output of $-I-(F-I)A$. The integrator output $(+I)$ is summed at the node of A4 with the output of A3 to provide:

$$+I-I-(F-I)A = (-F-I))A \text{ or } (I-F)A \quad (14)$$

After inversion by amplifier A4 the multiplier input then becomes $$(F-I)A \times 3.$$

This voltage, together with the gain control voltage holds the multiplier output at $\pm$ 5 volts for draws as long as $(F-I)A \times 3$ exceeds $\pm$ 0.625 volts. For values below that level, the multiplier output becomes $$8 \times (F-I)A \times 3.$$

To reiterate, if

I = the X OUT voltage of the cathode-ray tube (the instantaneous output position signal);

F = the final X OUT voltage when the vector is complete;

A = the gain from X OUT to the output of amplifier A3; and

S = the voltage at X OUT at the beginning of the vector draw.

The general vector to be drawn is from S to F on the vector diagram. The substraction F–I is performed at the input of amplifier A1. F–I is a new vector always with the same direction as the original vector but with the starting end at the origin. At the beginning of the vector draw F–I is also equal to F–S. Since the starting end of F–I is at the origin, the vector may be multiplied by a number less than 1 to produce a new vector with the same direction as F–I but with less magnitude. This new vector is (F–I)A on the vector diagram. If the new vector is translated by adding I, it will be positioned back on the original vector with the same direction but with less mgnitude than the original vector. Now, the vector drawing circuits that receive the new vector are controlled to draw a vector similar to the original but shorter in length. The vector (F–I)A + I appears inverted at the output of amplifier A3.

In the system of FIG. 6, the dynamic range of the multiplier 200 is 8:1. Therefore, when drawing a vector, the value of A must be switched to increase the dynamic range of the overall system without increasing the dynamic range of the multiplier, since increasing the multiplier dynamic range would cause undesirable side effects of reduced accuracy and bandwidth.

The system of FIG. 6 switches A to 1, as I approaches F before the end of the vector. This provides additional advantages. The output of amplifier A3 is -I-(F–I)A, and if A = 1, this becomes −F, a fixed value that does not change as the remainder of the vector is drawn.

The only circuits settling to final value at the end of the vector are the output varible gain loops consisting of amplifiers A4 and A5, and the multiplier. The input network settles to its final value well before the output loop settles to the end of vector value, resulting in fast settling of the output loop.

The filter loop consisting of the amplifiers A2 and A3 is necessary to smooth the step changes caused by the closing of switches SW1 and SW2 at the input of amplifier of A2, thereby enabling the variable gain output loop to follow the changes and keep the vector velocity constant.

The invention provides, therefore, an improved vector generator system which has certain advantages over the system described in the U.S. Pat. No. 3,772,563, in that it requires only one multiplier stage per channel instead of three, and therefore less adjustments and greater stability. Also, the system of the present invention requires shorter drawing time for short vectors. The system also has a readily programmable drawing rate. Moreover, the system has the advantage in that the vector generator remains on at all times, so that its output does not change with time when vector drawing is terminated. The hold switch is only closed to suppress transients during the vector drawing process. When vectors are not being drawn, all vector generator loops are active and will hold the vector generator output to the last vector position.

With respect to the feature of a shorter drawing time for short vectors, since the variable gain loop, that is the amplifiers A4 and A5, the multiplier 200, has less multipliers in the loop than the previous system, it has less poles and greater bandwidth is possible, therefore creating the ability to draw short vectors at a faster rate. Also, since the output of amplifier A3 becomes -F before the end of vector is reached, the hold switch may be closed and new end point data introduced to the system while the vector generator is still drawing the end point. Settling of the input circuits may then be overlapped with vector drawing for faster overall operation.

It will be appreciated that although a particular embodiment of the invention has been shown and described, modifications may be made. It is intended in the claims to cover the modifications which come within the spirit and scope of the invention.

What is claimed is:

1. A system for generating a vector signal including: circuit means including a multiplier circuit; an integrator coupled to the output of said circuit means; a gain control circuit; means connecting said gain control circuit to said multiplier circuit to control the gain of the multiplier circuit to cause the multiplier circuit to generate a constant output so as to constitute a constant current source for said integrator for linear integration thereby; and a computing network for increasing the dynamic range of the system, said computing network generating an output representing the function (F–I)A; where F represents an end point, I represents the instantaneous value of the output of the system, and A is a value which changes as the output moves towards the end point F.

2. A system for generating a vector signal including: a first operational amplifier circuit (A1) including a node input terminal for receiving a step function input current and for producing an inverted output current in response thereto; a first feedback circuit connected between the output of the first operational amplifier and said node input terminal for feeding back current from the output of the first operational amplifier to the node input thereof; a second operational amplifier circuit (A4) including a node input terminal for receiving an input and for producing an inverted output current in response thereto; first circuit means connecting the output of the first amplifier circuit (A1) to the node input terminal of the second operational amplifier circuit (A4) to cause said second operational amplifier (A4) to produce an inverted output current in response thereto; a second feedback circuit connected between the output of the second operational amplifier circuit (A4) and the node input terminal thereof; an integrator circuit including an operational amplifier (A5) having a node input terminal; second circuit means connecting the output of the second opertional amplifier (A4) to the node input terminal of the operational amplifier (A5) in the integrator circuit; and a third feedback circuit connected between the output of the integrator circuit and the node input terminal of the first operational amplifier (A1) to feed the integrator output current back to the node input of the first operational amplifier circuit (A1) to cause the output thereof to stabilize at a value such that the feedback current through the first feedback circuit equals the input current plus the feedback current to the third feedback circuit, so as to provide a constant current input to the integrator circuit with resulting linear integration.

3. The system defined in claim 2, in which said first circuit means includes a third operational amplifier (A2) and a further operational amplifier (A3); and in which said third feedback circuit is also connected to the node input terminals of the third operational amplifier (A2) and of the second operational amplifier circuit (A4) to provide a closed loop configuration for controlling the time constant of the integrator circuit.

4. The system defined in claim 2, in which said second circuit means includes a multiplier circuit.

5. The system defined in claim 3, in which said first circuit means includes a first resistance network interposed between the third operational amplifier (A2) and the second operational amplifier (A4), and a first selective switching means connected to the first resistance network.

6. The system defined in claim 3, and which includes a resistance network interposed between the first operational amplifier circuit (A1) and the third operational amplifier (A2), and selective switching means connected to the resistance network.

7. The system defined in claim 6, in which said second circuit means includes a multiplier circuit, and which includes a second resistance network interposed between the multiplier and the node input terminal of the second operational amplifier circuit (A4); and a second selective switching means connected to said second resistance network.

8. The system defined in claim 4, and which includes a gain control circuit connected to said multiplier circuit for controlling the gain thereof; and means connecting the output of the second operational amplifier (A4) to the gain control circuit for supplying an error signal thereto, to cause the multiplier circuit to generate a constant output so as to constitute a constant current source for said integrator for linear integration thereby.

9. The system defined in claim 7, and which includes a control circuit connected to said first and second selective switching means to cause different resistances of said first and second resistance networks to be switched into the system selectively to control the vector drawing rates of the system to selected predetermined values.

10. The system defined in claim 6, and which includes a control circuit connected to the output of the first operational amplifier circuit (A1) and connected to said selective switching means to control the gain of the first circuit means selectively between predetermined values.

* * * * *